US009280109B2

(12) United States Patent
Tsunoda

(10) Patent No.: US 9,280,109 B2
(45) Date of Patent: Mar. 8, 2016

(54) FIXATION DEVICE AND IMAGE FORMATION APPARATUS

(71) Applicant: Oki Data Corporation, Tokyo (JP)

(72) Inventor: Shigeru Tsunoda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/302,607

(22) Filed: Jun. 12, 2014

(65) Prior Publication Data

US 2014/0369727 A1 Dec. 18, 2014

(30) Foreign Application Priority Data

Jun. 13, 2013 (JP) ..... 2013-124936

(51) Int. Cl.
*G03G 15/20* (2006.01)

(52) U.S. Cl.
CPC .... *G03G 15/2064* (2013.01); *G03G 2215/2006* (2013.01); *G03G 2215/2029* (2013.01); *G03G 2215/2032* (2013.01)

(58) Field of Classification Search
CPC ..... G03G 15/2017; G03G 15/2032; G03G 15/2064; G03G 15/2067
USPC ..... 399/329
See application file for complete search history.

(56) References Cited

U.S. PATENT DOCUMENTS

| | | | | |
|---|---|---|---|---|
| 7,664,452 | B2 * | 2/2010 | Nakajima | 399/329 |
| 2005/0185996 | A1 * | 8/2005 | Oishi et al. | 399/329 |

FOREIGN PATENT DOCUMENTS

| | | | |
|---|---|---|---|
| JP | 2003-140482 | A | 5/2003 |
| JP | 2004-233837 | A | 8/2004 |
| JP | 2009-003441 | A | 1/2009 |
| JP | 2010-217232 | A | 9/2010 |
| JP | 2011048271 | A * | 3/2011 |
| JP | 2013-024895 | A | 2/2013 |

* cited by examiner

*Primary Examiner* — Erika J Villaluna
(74) *Attorney, Agent, or Firm* — Mots Law, PLLC

(57) ABSTRACT

A fixation device includes: a heating member; a fixation belt configured to be heated by the heating member and formed like an endless belt; a first fixation member configured to abut on an inner circumferential surface of the fixation belt; a second fixation member located upstream of the first fixation member in a paper conveyance direction and configured to abut on the inner circumferential surface of the fixation belt; a press member located between the first fixation member and the second fixation member and configured to abut on the fixation belt; a pressurization member configured to abut on an outer circumferential surface of the fixation belt, and press at least against the first fixation member and the press member via the fixation belt; a support frame configured to support the first fixation member; and a holding plate configured to support the press member.

14 Claims, 18 Drawing Sheets

STATE WITHOUT SUPPORT FRAME 48

○ : NOT DISTORTED

△ : PARTIALLY DISTORTED

× : DISTORTED IN ENTIRE REGION

Fig.21

| | FIRST FIXATION ROLLER | PAD | SECOND FIXATION ROLLER | PRESSURE DISTRIBUTION CHART | IMAGE DISTORTION EVALUATION RESULT | | |
|---|---|---|---|---|---|---|---|
| | | | | | PRINT SPEED ppm | | |
| | | | | | 40 | 30 | 20 |
| EMBODIMENT | SUPPORT FRAME | PAD LEVER | PAD LEVER | 22 | ○ | ○ | ○ |
| COMPARATIVE EXAMPLE (CONVENTIONAL CONFIGURATION) | SUPPORT FRAME | FIRST LEVER MEMBER | SECOND LEVER MEMBER | 23 | △ | △ | ○ |

○ : NOT DISTORTED
△ : PARTIALLY DISTORTED
× : DISTORTED IN ENTIRE REGION

| | FIRST FIXATION ROLLER | PAD | SECOND FIXATION ROLLER | PRESSURE DISTRIBUTION CHART | IMAGE DISTORTION EVALUATION RESULT | | |
|---|---|---|---|---|---|---|---|
| | | | | | PRINT SPEED ppm | | |
| | | | | | 50 | 45 | 40 |
| EMBODIMENT 1 | SUPPORT FRAME | PAD LEVER | PAD LEVER | 22 | × | △ | ○ |
| EMBODIMENT 2 | SUPPORT FRAME | PAD LEVER | SUPPORT FRAME | 29 | ○ | ○ | ○ |

○ : NOT DISTORTED
△ : PARTIALLY DISTORTED
× : DISTORTED IN ENTIRE REGION

FIXATION DEVICE AND IMAGE FORMATION APPARATUS

CROSS REFERENCE TO RELATED APPLICATIONS

This application claims priority based on 35 USC 119 from prior Japanese Patent Application No. 2013-124936 filed on Jun. 13, 2013, entitled "FIXATION DEVICE AND IMAGE FORMATION APPARATUS", the entire contents of which are incorporated herein by reference.

BACKGROUND OF THE INVENTION

1. Field of the Invention

The present disclosure relates to a fixation device used in an image formation apparatus such as a printer, a copier, a fax machine, a multifunction printer and the like, and an image formation apparatus including the fixation device.

2. Description of Related Art

In a conventional electrographic image formation apparatus, a charge roller uniformly charges a surface of a photosensitive drum, and thereafter an exposure unit such as a LED head exposes the surface of the photosensitive drum to light to form an electrostatic latent image according to image information. Toner in the form of a thin layer formed on a development roller is electrostatically attached to the electrostatic latent image to form a toner image. Then, a transfer roller transfers the toner image to a sheet on a conveyance belt for conveying sheets fed from a sheet feeder. After the toner image is transferred, a fixation device fixes the toner image to form an image on the sheet.

A fixation device disclosed in Japanese Patent Application Publication No. 2013-24895 is a fixation device with a belt heating scheme.

SUMMARY OF THE INVENTION

However, the fixation device as described above uses a pad as a pressing member, and may form a poor image in some cases.

An aspect of the invention is a fixation device that includes: a heating member; a fixation belt configured to be heated by the heating member and formed like an endless belt; a first fixation member configured to abut on an inner circumferential surface of the fixation belt; a second fixation member located upstream of the first fixation member in a paper conveyance direction and configured to abut on the inner circumferential surface of the fixation belt; a press member located between the first fixation member and the second fixation member and configured to abut on the fixation belt; a pressurization member configured to abut on an outer circumferential surface of the fixation belt, and press at least against the first fixation member and the press member via the fixation belt; a support frame configured to support the first fixation member; and a holding plate configured to support the press member.

According to this aspect, poor images can be suppressed.

BRIEF DESCRIPTION OF THE DRAWINGS

FIG. 21 is a table illustrating an evaluation result of each configuration when printing is performed with evaluation conditions set in the first embodiment.

DETAILED DESCRIPTION OF EMBODIMENTS

Figure 1:
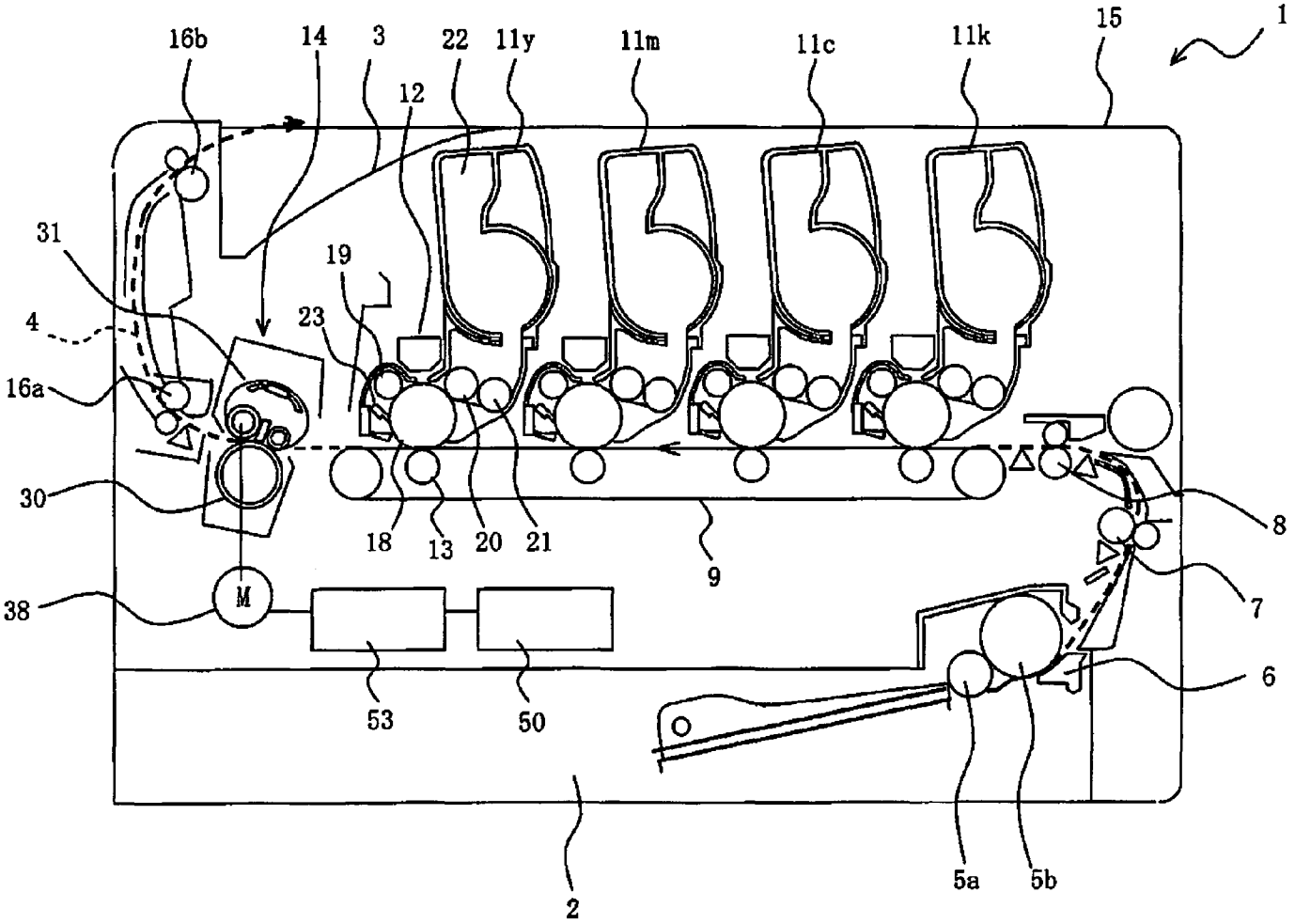
FIG. 1 is a schematic configuration diagram illustrating a printer according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Embodiments of the invention are described below.

First Embodiment

An image formation apparatus including a fixation device according to a first embodiment of the invention is described below. The fixation device according to the embodiment causes a holding plate (pad lever 46) to hold a pad and a second fixation roller.

First, a configuration of the image formation apparatus of the embodiment is described. FIG. 1 is a schematic configuration diagram illustrating a printer as the image formation apparatus according to the embodiment.

Reference numeral 1 in the drawing is a printer as an image formation apparatus which is an electrographic color printer for printing a color image. Paper cassette 2 houses paper P as a printing medium such as plain paper and is detachably mounted in the lower part of a device housing of printer 1. Note that the printing medium is not limited to paper P and may be any other medium which can be a printing target. Stacker 3 is where sheets of paper P on which an image is printed are stacked and is formed on upper cover 15 on a top surface of the device housing. Paper cassette 2 and stacker 3 are connected by a paper path which is roughly shaped like the letter S, shown by a dashed line in FIG. 1. A sheet feeder mechanism constituted of sheet feed rollers 5*a*, 5*b* and separation piece 6 is provided at a connection of paper path 4 and paper cassette 2. The sheet feeder mechanism separates sheets of paper P one by one and sends it from paper cassette 2 to paper path 4. Conveyance rollers 7 for holding paper in between and conveying paper P sent from the sheet feeder mechanism, and resist rollers 8 for correcting any oblique passage of conveyed paper P and conveying paper P, are arranged downstream of sheet feed roller 5*b* in a conveyance direction of paper P (hereinafter referred to as a paper conveyance direction), which is a medium conveyance direction. Conveyance belt 9 for conveying paper P is arranged downstream of resist rollers 8. On conveyance belt 9, image formation units 11 are arranged along the conveyance belt. Exposure head 12 for forming an electrostatic latent image is arranged above photosensitive drum 18 of image formation units 11 to be described below. Transfer roller 13 for transferring a toner image formed by each of image formation units 11 onto paper P is arranged on the side opposite to photosensitive drum 18 across an upper side of conveyance belt 9, which is below photosensitive drums 18. Fixation device 14 for fixing the toner image transferred onto paper P is arranged downstream of conveyance belt 9 in the paper conveyance direction. In addition, eject rollers 16*a*, 16*b* for holding therebetween paper P ejected from fixation device 14 and conveying paper P to stacker 3 located on upper cover 15 are arranged downstream of fixation device 14 in the paper conveyance direction.

Since printer 1 in the embodiment is a color printer, developers for black (k), cyan (c), magenta (m) and yellow (y) are used. This is because four image formation units 11 for respective colors are arranged in printer 1. Specifically, four independent image formation units 11*k*, 11*c*, 11*m*, 11*y* containing toner T as developers of black (k), cyan (c), magenta (m) and yellow (y) are arranged along the paper conveyance direction in the order of forming toner images. Since all of four image formation units 11*k*, 11*c*, 11*m*, 11*y* have an identical structure, one image formation unit 11 is described in the following.

Image formation unit 11 includes photosensitive drum 18 in which an electrostatic latent image is formed by exposure head 12, charge roller 19 for uniformly charging photosensitive drum 18, development roller 20 for applying toner T to the electrostatic latent image on photosensitive drum 18 to develop the image, supply roller 21 for supplying toner T to development roller 20, toner cartridge 22 containing toner T of a set color, cleaning blade 23 for scraping off toner T remaining on photosensitive drum 18 after transfer, and other parts. In addition, image formation unit 11 integrally includes the members described above and is detachably mounted on printer 1. Thus, upper cover 15 of printer 1 is configured to be openable and closable.

Exposure head 12 as an exposure unit is supported on upper cover 15 by a mount stay which is not shown. Exposure head 12 supported by the mount stay is arranged to be opposed to photosensitive drum 18 from above when upper cover 15 is closed. Exposure head 12 includes an illuminator such as a LED (Light Emitting Diode) light, a laser beam or the like. Then, with light of the illuminator, exposure head 12 forms an electrostatic latent image on the surface of photosensitive drum 18 on the basis of image information. A transfer voltage is applied to transfer roller 13 as a transfer unit. Then, with the transfer voltage applied to transfer roller 13, the toner image formed on photosensitive drum 18 is transferred onto paper P being conveyed by conveyance belt 9.

Fixation device 14 of the embodiment is a device with a belt heating technique. Fixation device 14 includes pressurization roller 30 as a pressurization member and fixation belt unit 31. Fixation device 14 may be undetachably mounted on printer 1 or may be detachably mounted on printer 1.

Figure 2:
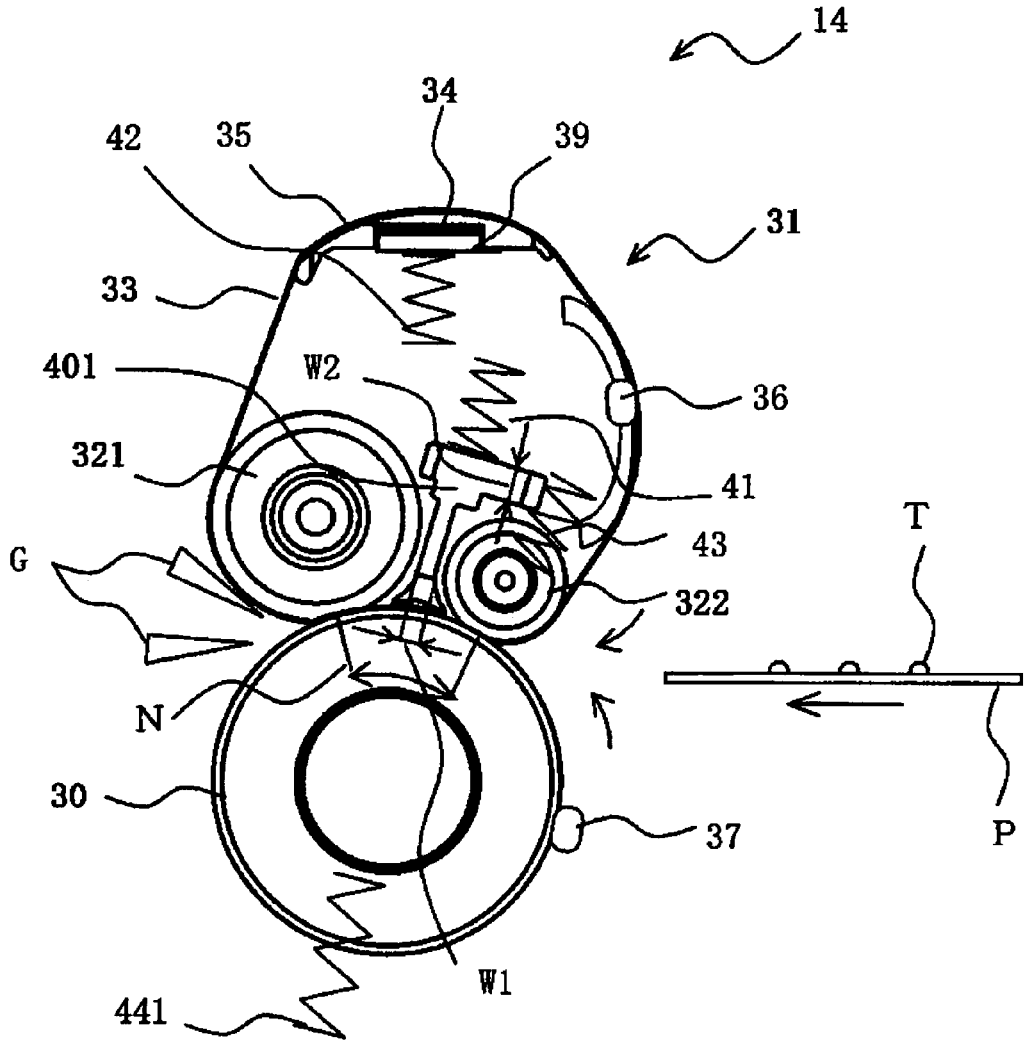
FIG. 2 is a side elevation view illustrating the structure of main parts of a fixation device of the printer according to the first embodiment.

A specific configuration of fixation device 14 is described below. In the following, a fixation device which uses a fixation belt and a surface heater capable of finishing warm-up in a short period of time is described. FIG. 2 is a side elevation view of main parts of fixation device 14 in the embodiment.

Fixation belt unit 31 of fixation device 14 includes fixation belt 33, first fixation roller 321, heater 34, heater holder 35 and other parts. Fixation belt 33 is designed to fix a toner image that has been transferred onto paper P by heating the toner image. Fixation belt 33 holds paper P with pressurization roller 30 and is rotated in a paper P conveyance direction. Inside fixation belt 33, are arranged first fixation roller 321, second fixation roller 322 for supporting and pressing fixation belt 33 toward pressurization roller 30, heater 34 for heating fixation belt 33, heater holder 35 supporting heater 34 and serving as a guide of fixation belt 33, and other parts.

In addition, pad 401 as a press member is arranged adjacent to first fixation roller 321 in the upstream of a rotation direction (paper conveyance direction) of first fixation roller 321. Second fixation roller 322 is arranged upstream of pad 401 in the paper conveyance direction and adjacent to pad 401. Here, pressurization roller 30 as a pressurization member, first fixation roller 321 of fixation belt unit 31, pad 401 and second fixation roller 322 are located in parallel to each other. In addition, first fixation roller 321, pad 401 and second fixation roller 322 of fixation belt unit 31 are opposed to pressurization roller 30 across fixation belt 33.

Figure 3:
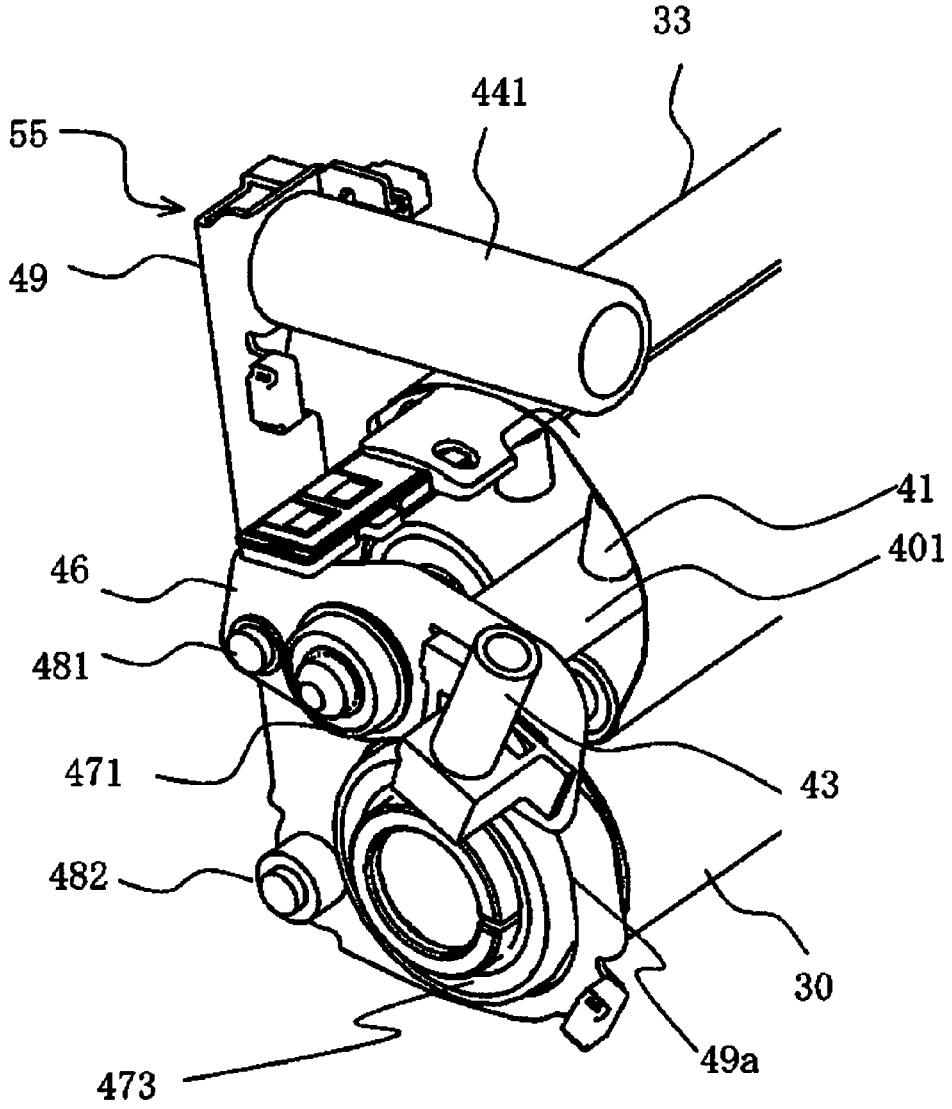
FIG. 3 is a perspective view illustrating a mounting structure of a pressurization roller and other parts.

Pressurization roller 30 is a pressurization member which abuts on the outer circumferential surface of fixation belt 33, and is in pressure contact, via fixation belt 33, with first fixation roller 321 as the first fixation member, second fixation roller 322 as the second fixation member, and pad 401 as the press member (a part of the nip formation member). As illustrated in FIG. 3, pressurization roller 30 is supported on press mechanism 55 and pressed against first fixation roller 321 by press mechanism 5 (see FIG. 2).

Figure 4:
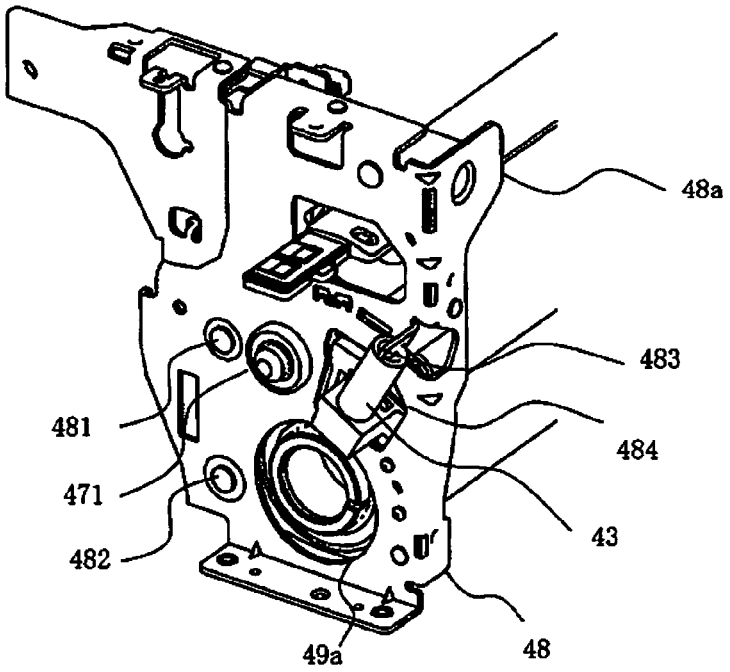
FIG. 4 is a perspective view illustrating a support frame to which the pressurization roller and other parts are mounted.

Press mechanism 55 is designed to support pressurization roller 30 as a pressurization member and to bring pressurization roller 30 into pressure contact with first fixation roller 321 and other parts. Press mechanism 55 mainly includes pressurization roller lever 49 and pressurization roller spring 441. Pressurization roller lever 49 is a pressurization lever swingably supported on support frame 48 (see FIG. 4) to support pressurization roller 30 as a pressurization member. Pressurization roller lever 49 is formed almost like the letter L, and pressurization lever pivot shaft 482 is provided at the corner thereof. Pressurization lever pivot shaft 482 is supported by support frame 48 of the apparatus main body. With this, pressurization roller lever 49 is swingably supported on support frame 48. At a position (lower end) adjacent to pressurization lever pivot shaft 482 of pressurization roller lever 49, pressurization roller support hole 49*a* supporting pressurization roller 30 is provided. Pressurization roller 30 is rotatably attached to pressurization roller support hole 49*a* of pressurization roller lever 49 via pressurization roller bearing 473. Pressurization roller spring 441 as a pressurization member bias unit is mounted in the upper part of pressurization roller lever 49. Spring support stay 48*a* supporting pressurization roller spring 441 is provided in support frame 48. With one end thereof mounted to the upper part of pressurization roller lever 49, the other end of pressurization roller spring 441 abuts on spring support stay 48*a*. With this, the upper end of pressurization roller lever 49 is biased by pressurization roller spring 441 supported on spring support stay 48*a*, with pressurization roller lever 49 swingably supported on support frame 48 by pressurization lever pivot shaft 482. Since the upper part of pressurization roller lever 49 is biased by pressurization roller spring 441, pressurization roller lever 49 supported by pressurization lever pivot shaft 482 rotates, and thus a force in the direction toward first fixation roller 321 acts on the lower end of pressurization roller lever 49. With this, pressurization roller 30 is pressed against first fixation roller 321. Pressurization lever pivot shaft 482 has a setting position thereof set so that pressurization roller 30 and first fixation roller 321 push each other toward the rotation center.

In addition, a pressurization member does not necessarily have to rotate, and may be a fixed guide whose surface is coated by a material with a low friction coefficient. In the embodiment, pressurization roller 30, which is a rotor rotating following fixation belt 33, is used as a pressurization member.

In addition, pad 401 is biased in the direction in which spring member 41, such as a compression coil spring or the like, presses pressurization roller 30 via fixation belt 33. Furthermore, second fixation roller 322 is also biased, by a given pressing force of second fixation roller spring 43 as a second fixation member bias unit, in the direction in which a press mechanism, which is not shown, presses pressurization roller 30.

With the above structure, nip part N having a predetermined width in the paper conveyance direction is formed between fixation belt unit 31 and pressurization roller 30. Separation guide G is provided downstream of nip part N.

In addition, belt temperature sensor 36 as a belt temperature detection unit is arranged inside fixation belt 33. Belt temperature sensor 36 is provided downstream of heater 34 and upstream of nip part N in the rotation direction of fixation belt 33. Belt temperature sensor 36 includes a thermistor which is in sliding contact with the inner circumferential surface of fixation belt 33 to detect a temperature of the inner circumferential surface of fixation belt 33. Belt temperature sensor 36 is supported on the device's main body side.

In addition, pressurization roller temperature sensor 37 as a pressurization roller temperature detection unit is arranged on the outer circumferential surface of pressurization roller 30. Pressurization roller temperature sensor 37 includes a thermistor which is in sliding contact with the outer circumferential surface of pressurization roller 30 to detect the surface temperature of pressurization roller 30. Pressurization roller temperature sensor 37 is supported on the device's main body.

Figure 5:
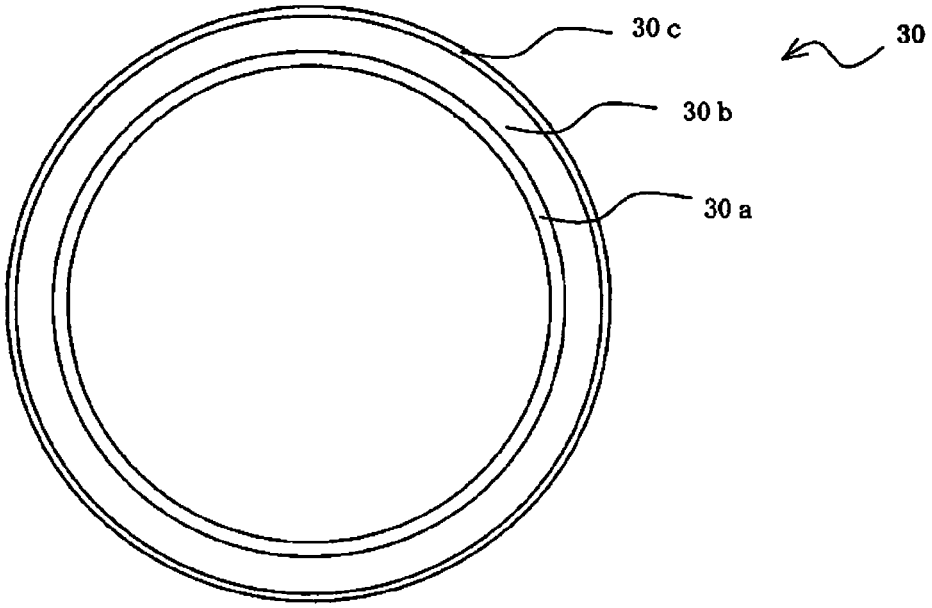
FIG. 5 is a side elevation view illustrating the pressurization roller.

As illustrated in FIG. 5, pressurization roller 30 as a pressurization member includes metal core 30*a* including a metal pipe or shaft made of iron, an aluminum alloy or the like, heat-resistant elastic layer 30*b* made of silicone rubber, fluorine resin or the like, and a mold release layer 30*c* made of fluorine resin or the like. Pressurization roller 30 is rotatably supported by a bearing, which is not shown.

Figure 6:
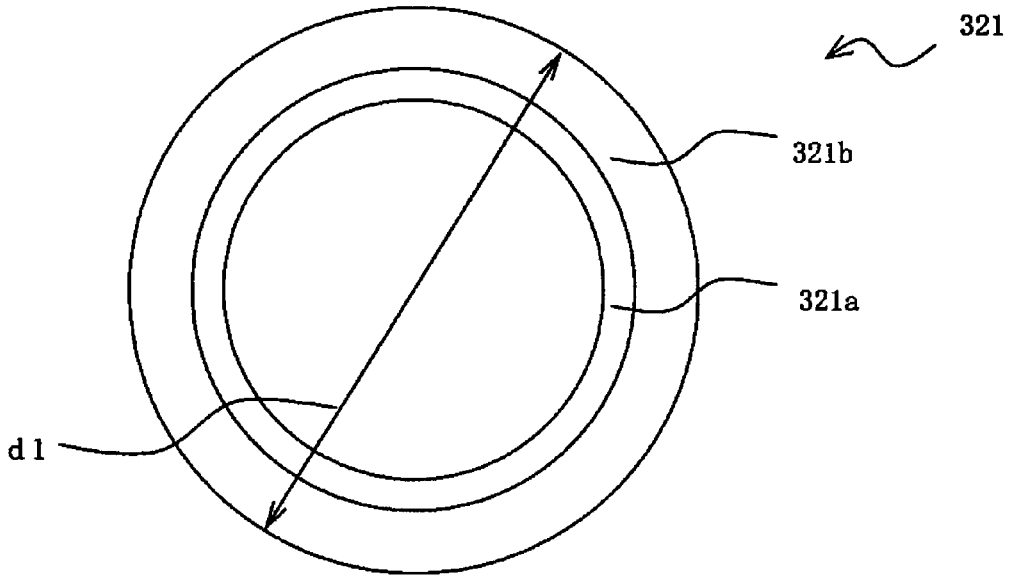
FIG. 6 is a side elevation view illustrating a first fixation roller.

First fixation roller 321 is a first fixation member which abuts on the inner circumferential surface of fixation belt 33. As illustrated in FIG. 6, first fixation roller 321 includes metal core 321*a* including a metal pipe or shaft made of iron, an aluminum alloy or the like and heat-resistant elastic layer 321*b* made of silicone rubber, a fluorine resin or the like. First fixation roller 321 is rotatably supported on support frame 48 by first fixation roller bearing 471 (see FIG. 4). Then, since first fixation roller 321 is passed through first fixation roller loose hole 464 (see FIG. 14) of pad lever 46, first fixation roller loose hole 464 allows a relative movement of first fixation roller 321, and first fixation roller 321 and pad lever 46 do not interfere with each other. A fixation roller gear, which is not shown, is provided in metal core 321*a*. Fixation motor 38 (see FIG. 15) engages with this fixation roller gear. With this, first fixation roller 321 is driven by the driving force transmitted from fixation motor 38 to rotate and drive fixation belt 33, and thereby conveys paper P in the paper conveyance direction shown by the arrow in FIG. 2.

An example of specific dimensions of first fixation roller 321 of the embodiment is as follows. First, fixation roller 321 has a metal core 321*a* which is an iron (STKM)-made pipe having an outside diameter of 20 mm, a thickness of 0.8 mm, an inside diameter of 18.4 mm, and a length of 230 mm.

A foamed silicon rubber (sponge) layer having a thickness of 2 mm and an expansion ratio of 2 is formed as elastic layer 321*b* on the outer circumferential surface of first fixation roller 321. With this, first fixation roller 321 has an outside diameter of 24 mm. In addition, the roller product hardness is set to ASKER-C70. First fixation roller 321 is shaped like a crown with an outside diameter of a center part being 0.2 mm larger than an outside diameter of both ends, so that the pressure distribution of first fixation roller 321 and pressurization roller 30 in the longitudinal direction is uniform.

Now, pressurization roller 30 rotates together with fixation belt 33. When first fixation roller 321 rotates by fixation roller 38, fixation belt 33 is driven to rotate by the friction force at nip part N. Then, as fixation belt 33 rotates, pressurization roller 30 is driven to rotate.

Figure 7:
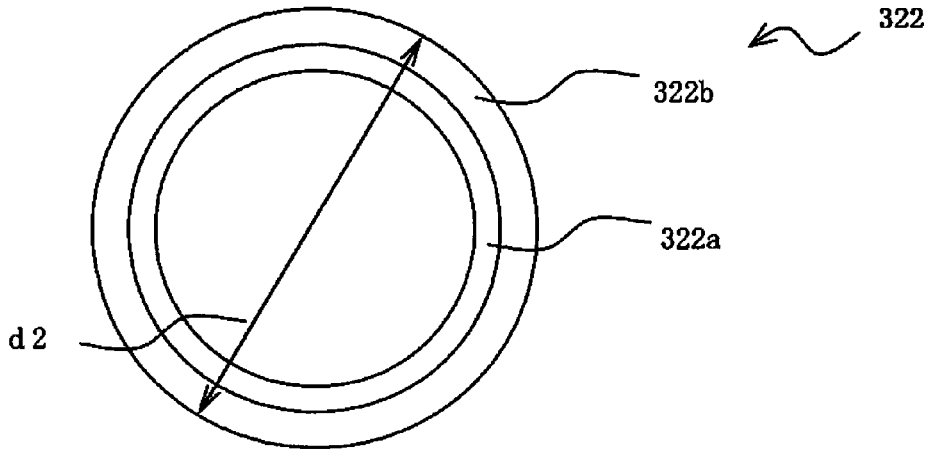
FIG. 7 is a side elevation view illustrating a second fixation roller.

Second fixation roller 322 is a second fixation member which abuts on the inner circumferential surface of fixation belt 33, and is located upstream of first fixation roller 321 in the paper conveyance direction. As illustrated in FIG. 7, second fixation roller 322 has a metal core 322*a* that includes a metal pipe or shaft made of iron, an aluminum alloy or the like and a heat-resistant elastic layer 322*b* made of silicone rubber, fluorine resin or the like. Second fixation roller 322 is rotatably supported by a bearing, which is not shown. As fixation belt 33 rotates, second fixation roller 322 is driven to rotate.

An example of specific dimensions of second fixation roller 322 of the embodiment is as follows. Second fixation roller 322 has a metal core 322*a* which is an iron (STKM)-made pipe having a diameter of 13 mm, a thickness of 0.8 mm, an inside diameter of 11.4 mm, and a length of 230 mm. A foamed silicon rubber (sponge) layer having a thickness of 1 mm and an expansion ratio of 2 is formed as elastic layer 323*b* on the outer circumferential surface of second fixation roller 322. With this, second fixation roller 322 is a roller with an outside diameter of 15 mm. In addition, the roller product hardness is set to ASKER-C80. Second fixation roller 322 is shaped like a crown with an outside diameter of a center part being 0.1 mm larger than an outside diameter of both ends, so that the pressure distribution of second fixation roller 322 and pressurization roller 30 in a longitudinal direction is uniform.

Figure 8:
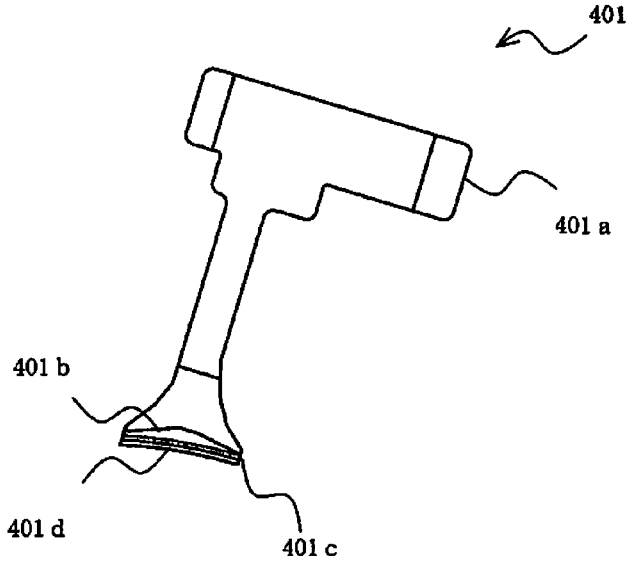
FIG. 8 is a side elevation view illustrating a pad.

As illustrated in FIG. 8, pad 401 includes support base material 401*a*, heat-resistant elastic material 401*b*, and slide layer 401*c*.

Support base material 401*a* is a member for supporting heat-resistant elastic material 401*b* and slide layer 401*c*. Support base material 401*c* includes a bar stock having an almost T-shaped cross section. Furthermore, the support base material 401*a* is made of such metal as iron, an aluminum alloy or the like. Since support base material 401*a* supports heat-resistant elastic material 401*b* and slide layer 401*c*, it has a shape with a widened tip on the pressurization roller 30 side.

Heat-resistant elastic material 401*c* is a member for elastically supporting slide layer 401*c*, and is adhesively-fixed to the tip on pressurization roller 30 of support base material 401*a*.

Sliding layer 401*c* is a layer which is caused to make pressure contact with the inner circumferential surface of fixation belt 33 so as to press fixation belt 33 against pressurization roller 30. Sliding layer 401*c* is provided on the surface of heat-resistant elastic material 401*b* to reduce the frictional resistance with the inner circumferential surface of fixation belt 33. Arcuate face 401*d* of slide layer 401*c* is set to the same curvature as that on the pressurization roller 30 side, including fixation belt 33. In addition, the width of nip part N can be changed by changing the length of arcuate face 401*d* of pad 401.

As illustrated in FIG. 2 and FIG. 3, spring 41 is a bias unit for pressing pad 401 against pressurization roller 30 at a set pressure. A plurality of springs 41 are arranged at intervals in the longitudinal direction of pad 401. The positions, the intervals, the pressing force and the like of springs 41 are set such that the pressure distribution in the longitudinal direction can be uniform.

Figure 9:
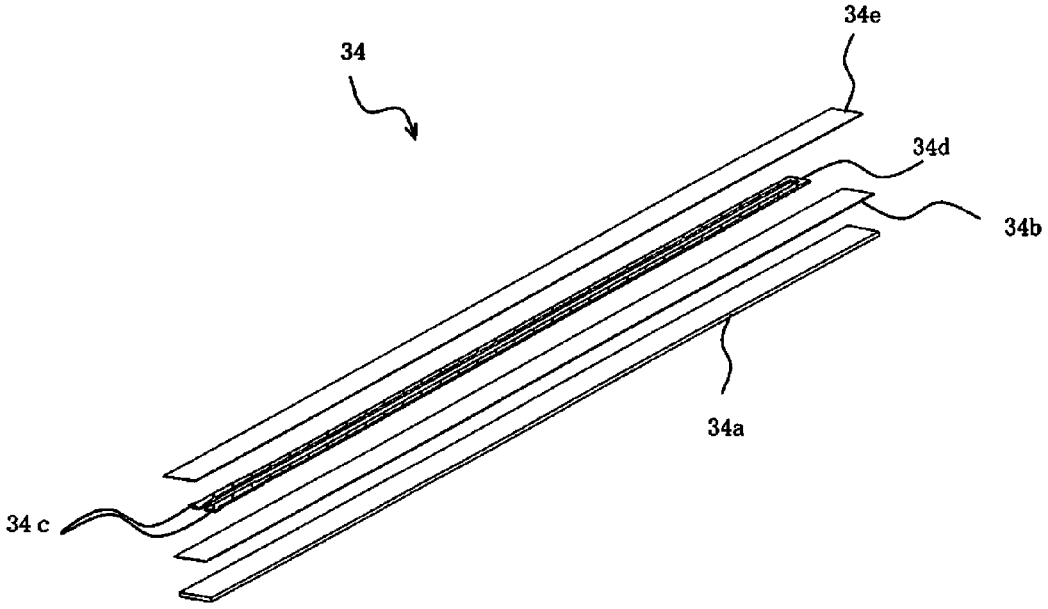
FIG. 9 is a perspective view illustrating a heater.

As illustrated in FIG. 9, heater 34 as a heating member includes a substrate 34*a*, electric insulation layer 34*b*, resistance heating element 34*d*, and protection layer 34*e*. Substrate 34*a* is made of a belt-like stainless steel, ceramic, or the like. Electric insulation layer 34*b* made of glass or the like is provided on substrate 34*a*. Then, resistance heating element 34*d* having electrode 34*c* is formed on electric insulation layer 34*b* and is protected by protection layer 34*e*. Thus, heater 34 is formed to be a plate-shaped heater or a sheet-shaped heater.

The resistance heating element 34*d* can be made of a material such as a nickel-chromium alloy, a silver-palladium alloy or the like. In addition, pressure-proof glass is glass-coated on protection layer 34*e*.

Heater holder 35 in FIG. 2 extends fixation belt 33 in a tensioned state with first fixation roller 321 and second fixation roller 32, and supports fixation belt 33 to be rotatable. Heater holder 35 is arranged in a position spaced from and opposed to first fixation roller 321 and second fixation roller 322. Furthermore, heater holder 35 extends fixation belt 33 in a tensioned state with first fixation roller 321, second fixation roller 33, and pad 401, and supports fixation belt 33 to be rotatable. Heater holder 35 is made of a metal such as an aluminum alloy.

Heater 34 is arranged in a channel provided opposite to the fixation belt sliding contact surface of heater holder 35, and is further fixedly-supported by being sandwiched between heater pressurization plates 39. Heat-resistant thermally conductive grease is applied to both faces of heater 34 which is in contact with heater holder 35 and heater pressurization plates 39. Furthermore, heater 34 and other parts are biased in a direction of stretching out fixation belt 33 via heater pressurization plates 39, by a predetermined pressing force of heater spring 42 of a press mechanism, which is not shown.

Figure 10:
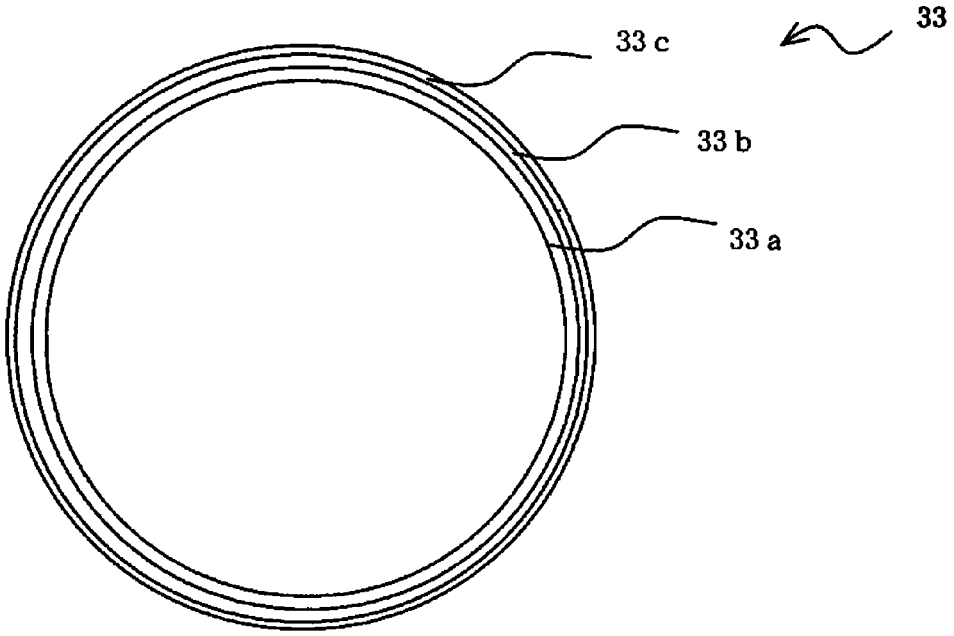
FIG. 10 is a side elevation view illustrating a fixation belt.
Figure 11:
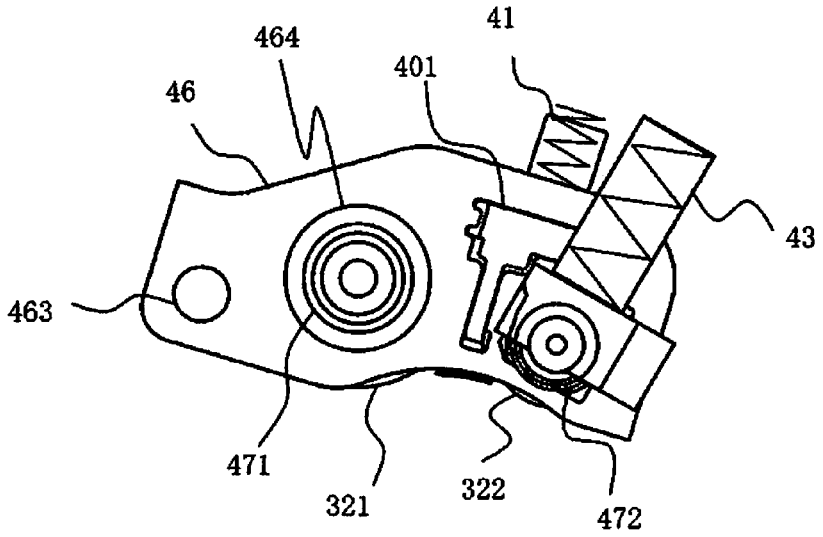
FIG. 11 is a side elevation view illustrating a pad lever to which the first fixation roller and other parts are attached.
Figure 12:
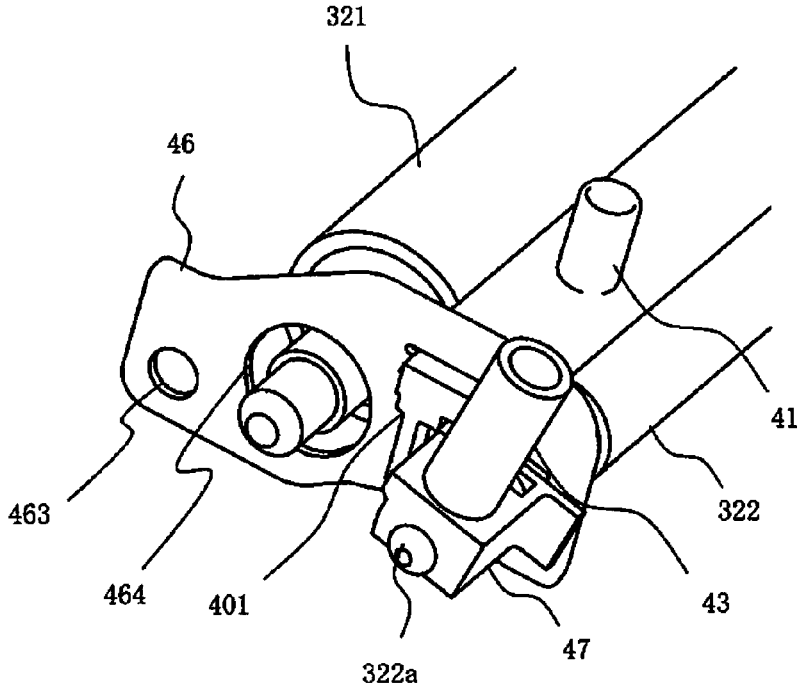
FIG. 12 is a perspective view illustrating a mounting structure of the first fixation roller, the second fixation roller and the pad.
Figure 13:
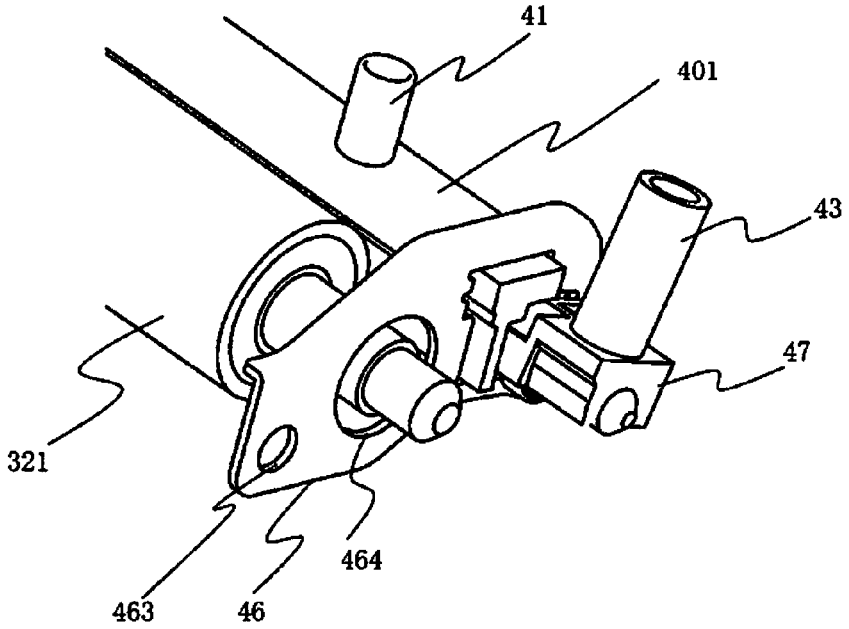
FIG. 13 is a perspective view illustrating a mounting structure of the first fixation roller, the second fixation roller and the pad.

As illustrated in FIG. 10, fixation belt 33 as a belt member includes belt base material 33*a*, elastic layer 33*b*, and release mold layer 33*c*. Belt base material 33*a* is a cylindrical member formed of a material such as nickel, polyimide, or stainless steel. Heat-resistant elastic layer 33*b* made of silicone rubber, fluorine resin or the like is provided on an outer circumferential surface of cylindrical belt base material 33*a*. Release mold layer 33*c* made of fluorine resin or the like is formed on an outer circumferential surface of elastic layer 33*b*. Fixation belt 33 rotates as first fixation roller 321 rotates. To be specific, the rotation of first fixation roller 321 is transmitted to fixation belt 33 by the frictional force at nip part N, and fixation belt 33 is thus driven to rotate and the entire fixation belt 33 is heated by heater 34.

Pressurization roller 30 of the embodiment has a metal core 30*a* which is an iron (SKTM)-made pipe having a diameter of 33.6 mm, a thickness of 0.5 mm, and a length of 230 mm. A 1.2-mm thick silicone rubber layer is formed as elastic layer 30*b* on the outer circumferential surface of pressurization roller 30. A surface of the layer is covered by a perfluorovinyl ether copolymer (PFA) resin tube with a thickness of 30 μm as mold release layer 30*c*. With this, pressurization roller 30 has an outside diameter of 36 mm. In addition, the roller product hardness is set to ASKER-C75.

Pad 401 of the embodiment is so configured that support base material 40*a* is made of an aluminum alloy (A60603), heat-resistance elastic material 401*b* is formed of a silicone rubber, and the 30 μm-thick silicone-based resin is coated as slide layer 401*c*. The arcuate length of arcuate face 401*d* is set to 5 mm. Hardness of the silicone rubber is set to JISA40. In addition, arcuate face 401*d* is shaped like a crown with a center part being 0.1 mm convex to both ends, so that the pressure distribution of pad 401 and pressurization roller 30 in the longitudinal direction is uniform. Note that while pad 401 is configured so that slide layer 401*c* is a coating, pad 401 may also be configured so that heat-resistant elastic layer 401*b* is covered by a sheet-like fluorine resin. In addition, pad 401 may be so configured that heat-resistant elastic layer 401*b* is covered by a glass cloth which is a fluorine-resin-coated glass fiber.

A clearance between pad 401 of nip part N and first fixation roller 321 is set to about 1 mm, and a clearance between pad 401 and second fixation roller 322 is about 1 mm. In addition, in this embodiment, while nip part N of pad 401 is formed in an arcuate shape, it may be formed in a planar shape.

Fixation belt 33 of the embodiment is an endless belt which uses a cylindrical member made of a 70 μm-thick polyimide (PI) resin as belt base material 33*a*, provides a 100-μm thick silicone rubber layer as elastic layer 33*b*, and forms a 15

μm-thick PFA resin layer in an endless band shape as mold release layer 33*c*. In addition, as a belt circumferential length of fixation belt 33 is longer, a longer time is needed to raise the temperature. On the one hand, as the belt circumferential length is short, fixation belt 33 has such an insufficient internal space that fixation belt 33 cannot be arranged while ensuring outside diameters of the fixation rollers and the size of a pad base material which are necessary to ensure a nip width. For this reason, an inside diameter of fixation belt 33 is set to 50 mm for the configuration of first and second fixation rollers 321, 322 and pad 401 as described above.

Pressurization roller 30 is set so that press mechanism 55 presses first fixation roller 321 with a total pressing force of 30 kgf for both sides, or in other words, 15 kgf each for one side. Furthermore, pad 401 is set to press pressurization roller 30 with a total load of 8 kgf. Second fixation roller 322 is set so that a press mechanism, which is not shown, presses pressurization roller 30 with a total pressing force of 8 kgf for both sides, or in other words, 4 kgf each for one side.

With the above configuration, the nip width (length in the paper conveyance direction) formed by pressurization roller 30 and first fixation roller 321 is set to 8 mm. The nip width (length in the paper conveyance length) formed by pressurization roller 30 and pad 401 is set to 6 mm. The nip width (length in the paper conveyance length) formed by pressurization roller 30 and second fixation roller 322 is set to 4 mm. The width of the nip part N (length in the paper conveyance length) is set to about 1.8 mm. Note that the clearance of about 1 mm between pad 401 on nip part N and first fixation roller 321 and the clearance of 1 mm between pad 40 and second fixation roller 322 are included in the nip width of 8 mm, 6 mm, and 4 mm mentioned above.

Pad lever 46 as a holding plate in this embodiment is a member for support pad 401 and second fixation roller 322. FIG. 3, FIG. 11, FIG. 12 and FIG. 13 illustrate a mode of support pad 401 and second fixation roller 322 by pad lever 46. In addition, FIG. 14 illustrates a lateral shape of pad lever 46.

Figure 14:
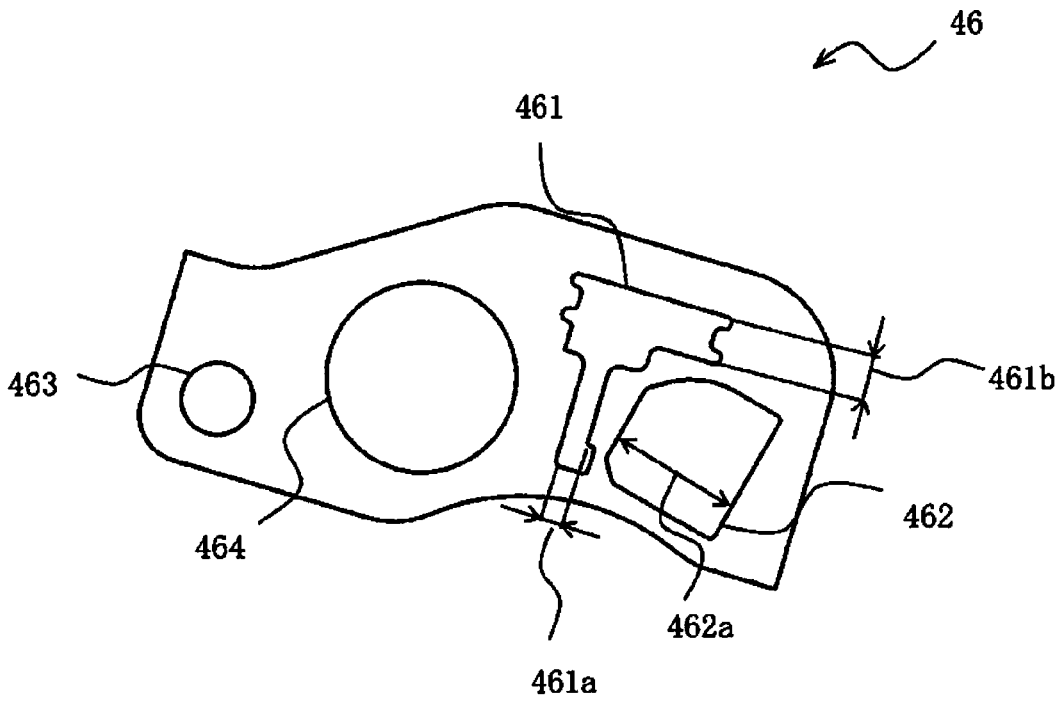
FIG. 14 is a side elevation view illustrating the pad lever.

As illustrated in FIG. 14, pad lever 46 includes second fixation roller support hole 462, pad support hole 461, first fixation roller loose hole 464 and pad lever pivot hole 463, which are arranged in that order from the upstream side in the paper conveyance direction. Second fixation roller support hole 462 extends in a biasing direction of second fixation roller spring 43 and holds second fixation roller 322 such that second fixation roller 322 can slide in the direction of pressing pressurization roller 30 without backlash in a direction orthogonal to the direction of pressing pressurization roller 30, that is, in the paper conveyance direction. Pad support hole 461 fixedly holds pad 401. First fixation roller loose hole 464 loosely holds a metal core shaft part of first fixation roller 321 (letting the metal core pass through without touching). Pad lever pivot hole 463 supports pad lever 46 in a manner rotatable on support frame 48.

Pad lever 46 is swingably supported on support frame 48. Specifically, pad lever pivot hole 463 of pad lever 46 is fitted into pivot shaft 481 (see FIG. 4) and mounted to support frame 48. Pad lever 46 is swingably supported on support frame 48, with pivot shaft 481 as the center of the swing. With this, pad lever 46 swingably supports pad 401 in a direction orthogonal to the paper conveyance direction. Since pad 401 is thus supported by pad lever 46 which is swingably supported on support frame 48, pad 401 can press slide layer 401*c* at the tip thereof against pressurization roller 30 via fixation belt 33, accurately and reliably without backlash. Pad 401 is biased by pad spring 41 to a rotation center direction of pressurization roller 30. With this, and being supported by pad lever 46, pad 401 can stably press slide layer 401*c* against pressurization roller 30 at a set pressure by means of pad spring 41.

As described above, pad 401 is mounted in pad support hole 461 of pad lever 46 and is supported tightly so as not to shake. Pad 401 is configured, specifically, as illustrated in FIG. 11 to FIG. 14. Since a cross-section shape of pad 401 is almost like the letter T, pad support hole 461 of pad lever 46 is correspondingly also formed almost like the letter T. Board thickness W1, W2 (see FIG. 2) of pad 401 and hole width 461*a*, 461*b* (see FIG. 14) of pad support hole 61 have a dimensional relationship of a minimal clearance. With this, pad 401 is tightly held on pad lever 46 so as not to shake. As a result of this, pad 401 is supported on pad lever 46, does not interfere with any other member, and rotates around pivot shaft 481 fitted into pad lever pivot hole 463. Pad 401 supported on pad lever 46 is located between first fixation roller 321 as a first fixation member and second fixation roller 322 as a second fixation member. Pad 401 is part of a nip formation member, and the nip formation member includes a press member (pad 401) for pressing the pressurization member, and a holding plate (pad lever 46) swingably supported on support frame 48, supporting press member (pad 401), and guiding it while preventing a tip thereof from shaking.

Second fixation roller 46 is mounted to pad lever 46 via second fixation roller bearing member 47. To be specific, second fixation roller 46 is rotatably supported on second fixation roller bearing member 47, with a metal core shaft end of second fixation roller 322 being passed through second fixation roller support hole 462 of pad lever 46. Second fixation roller bearing member 47 is slidably held in a direction in which second fixation roller bearing member 47 moves close to or apart from second fixation roller support hole 462 of pad lever 46. Second fixation roller 32 is supported on second fixation roller bearing member 47 and is designed to move close to or apart from the rotation center of pressurization roller 30, without any interference between second fixation roller 32 and pressurization roller 30 This is in a state in which second fixation roller 32 is supported on pad lever 46 and its set spacing with pad 401 is maintained.

Second fixation roller 322 is biased by second fixation roller spring 43 to the rotation center direction of pressurization roller 30. Second fixation roller 322 is supported on second fixation roller bearing member 47. Second fixation roller bearing member 47 is biased by second fixation roller spring 43. Second fixation roller bearing member 47 slides to the rotation center direction of pressurization roller 30 along second fixation roller support hole 462 of pad lever 46. Second fixation roller spring 43 is held between second fixation roller bearing member 47 and spring support stay 483 (see FIG. 4) which is cut and raised in support frame 48. With this, second fixation roller spring 43 generates a biasing force for biasing second fixation roller bearing member 47 to the rotation center direction of pressurization roller 30. While pad 401 and second fixation roller 322 can swing by pad spring 41 and second fixation roller spring 43, pad 401 and second fixation roller 322 are provided in shapes not to interfere with support frame 48 throughout that range of swinging. Furthermore, pad 401 and second fixation roller 322 are supported on pad lever 46 so as not to interfere with each other.

In the embodiment, output of heater 34 is set to a total of 900 W. Print speed is set to 400 ppm for A4 portrait feeding.

Figure 15:
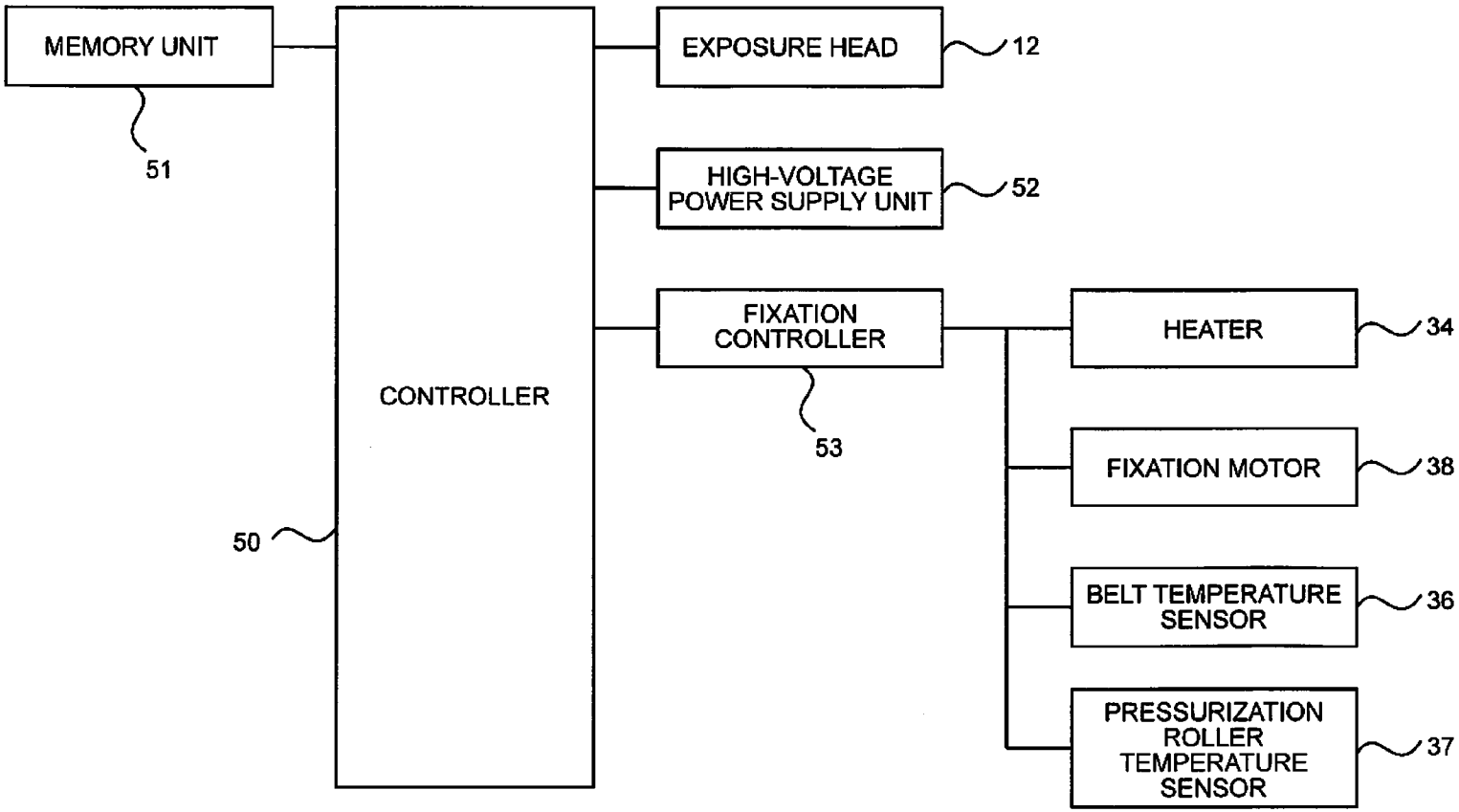
FIG. 15 is a functional block diagram illustrating a functional configuration of a printer according to the embodiment.

Now, FIG. 15 illustrates a functional configuration of printer 1 of the embodiment. Reference numeral 50 in the drawing is a controller of printer 1 that is connected with a host device such as a personal computer by way of a communication circuit, which is not shown. Controller 50 has functions such as a function to control each component in printer 1 to perform a printing process and the like, a function to control data communications with the host device and the like.

Reference numeral 51 in the drawing is a memory unit of printer 1 which stores programs to be executed by controller 50, various types of data to be used by printer 1, processing results of controller 50 and the like. Reference numeral 52 is a high-voltage power supply unit which applies a voltage to charge roller 19, development roller 20, supply roller 21, transfer rollers 13 and the like, based on an instruction of controller 50. In addition, when image formation unit 11 is mounted to printer 1, charge roller 19, development roller 20, supply roller 21 and the like are electrically connected with high-voltage power supply unit 52. The reference numeral 53 is a fixation controller which supplies power from a feeder circuit for heating to heater 34 of fixation device 14, which is not shown, on the basis of an instruction from controller 50. Fixation controller 53 also supplies power to fixation motor 38 to rotate first fixation roller 321 in the paper conveyance direction. In addition, to fixation controller 53 are inputted a temperature of fixation belt 33 which is detected by belt temperature sensor 36, and a surface temperature of pressurization roller 30 which is detected by pressurization roller temperature sensor 37, and the like. Controller 50 causes fixation controller 53 to turn ON or OFF power to be supplied to heater 34, on the basis of the temperature of fixation belt 33 inputted into fixation controller 53. Controller 50 also controls the surface temperature of fixation belt 33 so as to maintain it at a predetermined fixing temperature.

Operation of each unit in a printing operation of printer 1 of the embodiment is described next.

When controller 50 of printer 1 receives a print instruction from the host device, controller 50 starts printing in accordance with the print instruction. First, sheets of paper P housed in paper cassette 2 are separated one by one to be sent to paper path 4 by sheet feed rollers 5*a*, 5*b* and separation piece 6. Sent paper P is conveyed to conveyance belt 9 by conveyance rollers 7 and resist roller 8.

In parallel with this, controller 50 causes high-voltage power supply unit 52 to apply a predetermined voltage which has been set in advance to respective rollers of respective image formation units 11 and to transfer rollers 13. By charged voltages applied to charge rollers 19 of respective image formation units 11, surfaces of respective photosensitive drums 18 are charged uniformly, and respective exposure heads 12 are caused to emit light according to image information based on the print instruction. The surfaces of respective photosensitive drums 18 are exposed to form electronic latent images on the surfaces. Then, by causing development roller 20 to apply toner T supplied from supply roller 21 to the electrostatic latent images, the electrostatic latent images on photosensitive drums 18 are developed to form toner images of respective colors on the surfaces of photosensitive drums 18.

Then, paper P is conveyed to image formation unit 11 by conveyance belt 9. When paper P passes between photosensitive drum 18 of image formation unit 11 of each color and transfer rollers 13, the toner image of each color of black, cyan, magenta, and yellow is sequentially transferred onto paper P by the transfer voltage being applied to transfer rollers 13 to form a color toner image.

Paper P onto which the toner image is transferred is conveyed to fixation unit 14 and the toner image is fixed by fixation unit 14. Then, after being conveyed by eject roller 16*a*, paper P on which the toner image is fixed is ejected by eject roller 16*b* to stacker 3 on upper cover 15, and accumulated. With this, the printing operation is completed.

The fixing operation by fixation device 14 in this case is described below.

First, when the printing operation starts in printer 1, controller 50 causes fixation controller 53 to rotate fixation motor 38. By the rotation of fixation motor 38, the fixation roller gear of first fixation roller 321 of fixation device 14 is rotated to the paper conveyance direction by way of a gear array, which is not shown and is setup in the main body of printer 1, and first fixation roller 321 is rotated to the paper conveyance direction. First fixation roller 321, rotating in the paper conveyance direction, causes fixation belt 33 and pressurization roller 30 to be driven to rotate by a frictional force at the nip part.

In addition, controller 50 causes fixation controller 53 to supply power to heater 34 from a feeder circuit, which is not shown, thereby causing heater 34 to generate heat, and to heat fixation belt 33 from the inner circumferential surface thereof. A temperature of fixation belt 33 heated by heater 34 is detected by belt temperature sensor 36 and inputted into fixation controller 53. Based on the detected temperature of fixation belt 33, fixation controller 53 turns ON or OFF power to be supplied to heater 34 from the feeder circuit, and controls the surface temperature of fixation belt 33 so as to maintain it at a predetermined fixing temperature. When paper P onto which the toner image is transferred is conveyed in a state in which the surface temperature of fixation belt 33 is maintained at the predetermined temperature, paper P is grasped by nip part N. Nip part N is formed by second fixation roller 322, pad 401, first fixation roller 321, and pressurization roller 30, by way of fixation belt 33. The toner image is fixed on paper P through heating by fixation belt 33 at the predetermined fixing temperature and pressurization with a predetermined pressing force.

Then, pressurization roller 30 is supported on pressurization roller lever 49 of press mechanism 55. Pressurization roller lever 49 is supported on support frame 48 by pressurization lever pivot shaft 482. Furthermore, pressurization roller lever 49 is biased by pressurization roller spring 441, and presses pressurization roller 30 against first fixation roller 321 by the principle of leverage. Since first fixation roller 321 is then supported on support frame 48, pressurization roller 30 supported on pressurization roller lever 49 is biased to a direction heading for the rotation center of first fixation roller 321. Thus first fixation roller 321 and pressurization roller 30 become pressing against each other.

On the one hand, pad 401 is supported on pad lever 46, and is stably pressed against pressurization roller 30 by pad spring 41. The pressing direction of pad 401 is the rotation center direction of pressurization roller 30.

In addition, since second fixation roller 322 is slidably supported on pad lever 46, second fixation roller 322 is stably pressed against pressurization roller 30 by second fixation roller spring 43. Since second fixation roller 322 then slides to the rotation center of pressurization roller 30, first fixation roller 321 is pressed to the direction heading for the rotation center of pressurization roller 30.

With this, first fixation roller 321 is supported on support frame 48, and pressurization roller 30 is pressed against first fixation roller 21 by pressurization roller lever 49. Furthermore, pad 401 and second fixation roller 322, being independent of each other, are respectively supported on pad lever 46 and pressed against the rotation center of pressurization roller 30. As a result, pressurization roller 30, first fixation roller 321, second fixation roller 322, and pad 401, each of which independently moves, hold paper P via fixation belt 33. Thus, pressurization roller 30, first fixation roller 321, second fixation roller 322 and pad 401 press paper P at a pressure set for each member, without influencing each other.

In addition, in the embodiment, it is preferable that first fixation roller 321 starts to rotate immediately when the heater is turned ON, in order to prevent an excessive temperature elevation of the fixation belt. In the embodiment, it is set that first fixation roller 321 starts to rotate simultaneously when the heater is turned ON. In addition, a target temperature of the fixation belt in the embodiment is set to 160 degrees C., and a temperature of fixation belt 33 after heater 34 is turned ON is controlled so that when fixation is performed, the belt temperature falls within a predetermined temperature range with the target temperature as a median.

Figure 16:
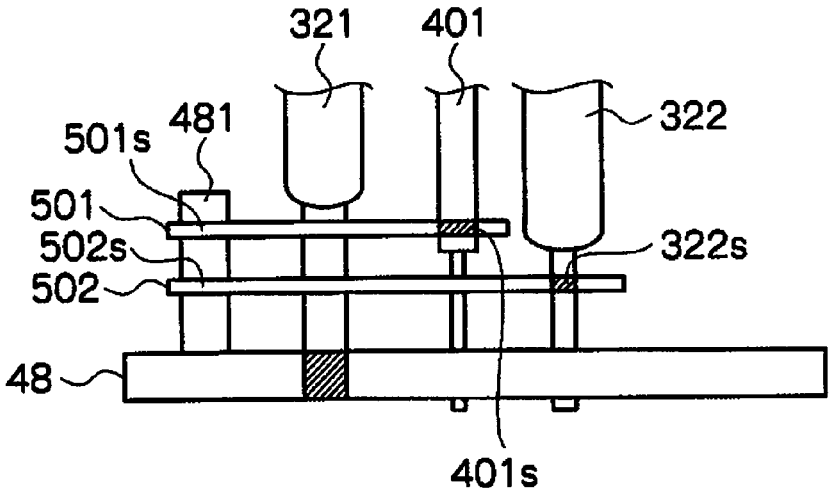
FIG. 16 is a schematic top view schematically illustrating a configuration of a comparative example.
Figure 17:
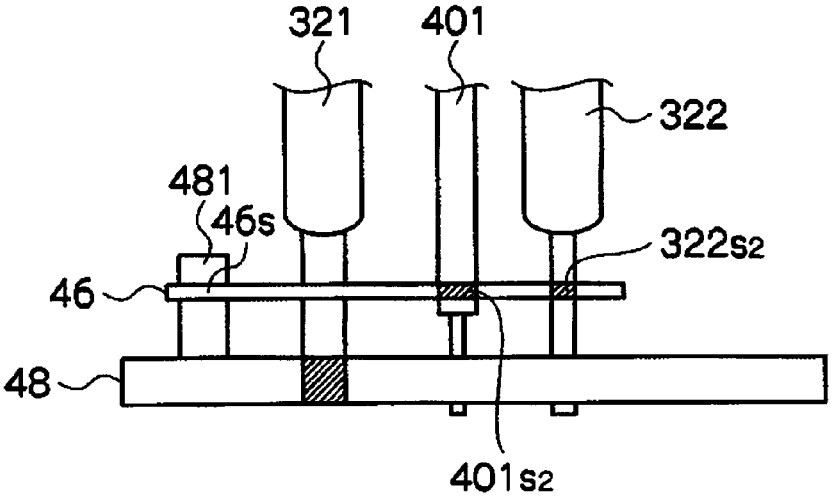
FIG. 17 is a schematic top view schematically illustrating configurations of embodiments of the invention.

Now, in fixation device 14 of the embodiment, an evaluation test is performed to check the influence on a toner image due to the difference in methods for holding second fixation roller 322. As a comparative example, a configuration is used in which a pad and a second fixation roller having a conventional configuration are each held in a separate lever member. FIG. 16 is a schematic top view schematically illustrating a configuration of the comparative example. FIG. 17 is a schematic top view schematically illustrating a configuration of the embodiment. To be specific, as illustrated in FIG. 16, first lever member 501, support pad 401 and second lever member 502 supporting second fixation roller 322 are rotatably provided in pivot shaft 481 of support frame 48. First fixation roller 321 is supported on support frame 48 and is designed not to interfere with first lever member 501 and second lever member 502.

On the one hand, as illustrated in FIG. 17, fixation device 14 having the configuration of the embodiment has pad lever 46 support pad 401 and second fixation roller 322 rotatably provided on pivot shaft 481 of support frame 48. First fixation roller 321 is supported on support frame 48 and is designed not to interfere with pad lever 46.

In the evaluation test, the fixation device of each configuration described above is mounted on printer 1, and printer 1 is powered on. Printer 1 then consecutively prints 10 sheets of A4-size paper P (Oki Data Excellent Paper, weighing capacity 64 g/m$^2$) after warming-up. In this printing, a print pattern with a single color toner duty of 100% is printed at three levels of print speeds of 40 ppm, 30 ppm, and 20 ppm for A4 portrait paper (or other print medium) feeding. In the test, the fixed image quality such as distortion, shift and unevenness of a fixed toner image on paper P (hereinafter referred to as "image distortion") is adopted as an evaluation item. Evaluation of the image quality is a result of a visual check on whether or not any non-uniform part (image distortion) on a sheet of paper is generated because not-fixed toner is displaced from a landed position during fixation. The image distortion represents the case where a shift of toner causes a bare surface of paper P to be seen or makes an unevenness in brightness recognizable. Here, the duty of the toner duty is defined as follows: 100% duty denotes solid printing on an entire printable area of a sheet at a printed area ratio of 100%, and 1% duty denotes printing on an area of 1% of the area printed at the 100% duty. "Density" is a density per predetermined area (for example, an area for 100 sheets, an area printed by 100 revolutions of a drum, or the like), and is determined from (1) the number of dots actually printed in the image formation on the predetermined area and (2) the total number of dots printable in the image formation on the predetermined area (this is the sum of the number of dots printed in image formation and the number of dots not printed in image formation, which is a total number of dots which can be potentially printed in image formation on the predetermined area). Specifically, "density=(1)/(2)×100".

Figure 18:
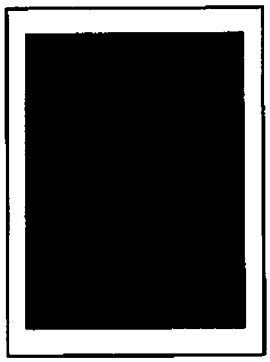
FIG. 18 is a schematic view illustrating that a fixed image when it is printed at three levels of print speeds is free from distortion.
Figure 19:
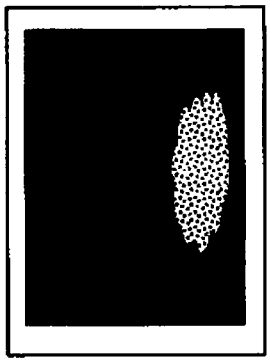
FIG. 19 is a schematic view illustrating that there occurs a distortion partially in a page of a fixed image when it is printed at three levels of print speeds.
Figure 20:
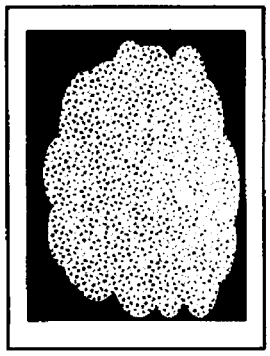
FIG. 20 is a schematic view illustrating that there occurs a distortion in the full-page of a fixed image when it is printed at three levels of print speeds.

In addition, in the embodiment, the image distortion is classified to three levels. FIG. 18, FIG. 19, and FIG. 20 are schematic views illustrating differences in the images. Specifically, the three levels are a fixed image free from any distortion (shown by ○) as illustrated in FIG. 18, a fixed image in which distortion occurs partially in a page (shown by Δ) as illustrated in FIG. 19, and a fixed image in which distortion occurs in a full-page (shown by x).

FIG. 21 illustrates the results of respective configurations under the evaluation conditions described above. As illustrated in FIG. 21, it can be seen that until the print speed reaches 40 ppm, no image distortion occurs (shown by ○) by virtue of the configuration of the embodiment in which pad 401 is arranged between first fixation roller 321 and second fixation roller 322.

In the comparative example, as illustrated in FIG. 16, since first fixation roller 321, second fixation roller 322 and pad 401 are supported by separate members (501, 502, 48), respectively, errors in dimensions occur. To be specific, in the comparative example, connections have to be made at the following four locations where the error in the dimensions occur: shaded area 401*s* of pad 401, shaded area 322*s* of second fixation roller 322, and connection 501*s* between first lever member 501 and pivot shaft 481, and connection 502*s* between second lever member 502 and pivot shaft 481, which are illustrated in FIG. 16.

In the embodiment, errors in dimensions occur in the three locations of shaded area 401*s*2 of pad 401, shaded area 322*s*2 of second fixation roller 322, and connection 46*s* between pad lever 46 and pivot shaft 481, which are illustrated in FIG. 17.

From this, the errors in the dimensions are larger in the comparative example, and the image distortion easily occurs when the print speed becomes fast to a degree (30 ppm or more).

In the comparative example, the spacing tries to expand at connection 502*s* between second lever member 502 and pivot shaft 481, and shaded area 322*s* of second fixation roller 322. Specifically, since contact is made with pressurization roller 30 from the outside by means of momentum, a repulsive force from pressurization roller 30 faces outward. Thus, as the force to open outwards acts and the width distance between pad 401 and second fixation roller 322 widens, the width of nip part N widens. It is believed that the image distortion occurs at the print speed of 30 ppm for this reason.

Figure 22:
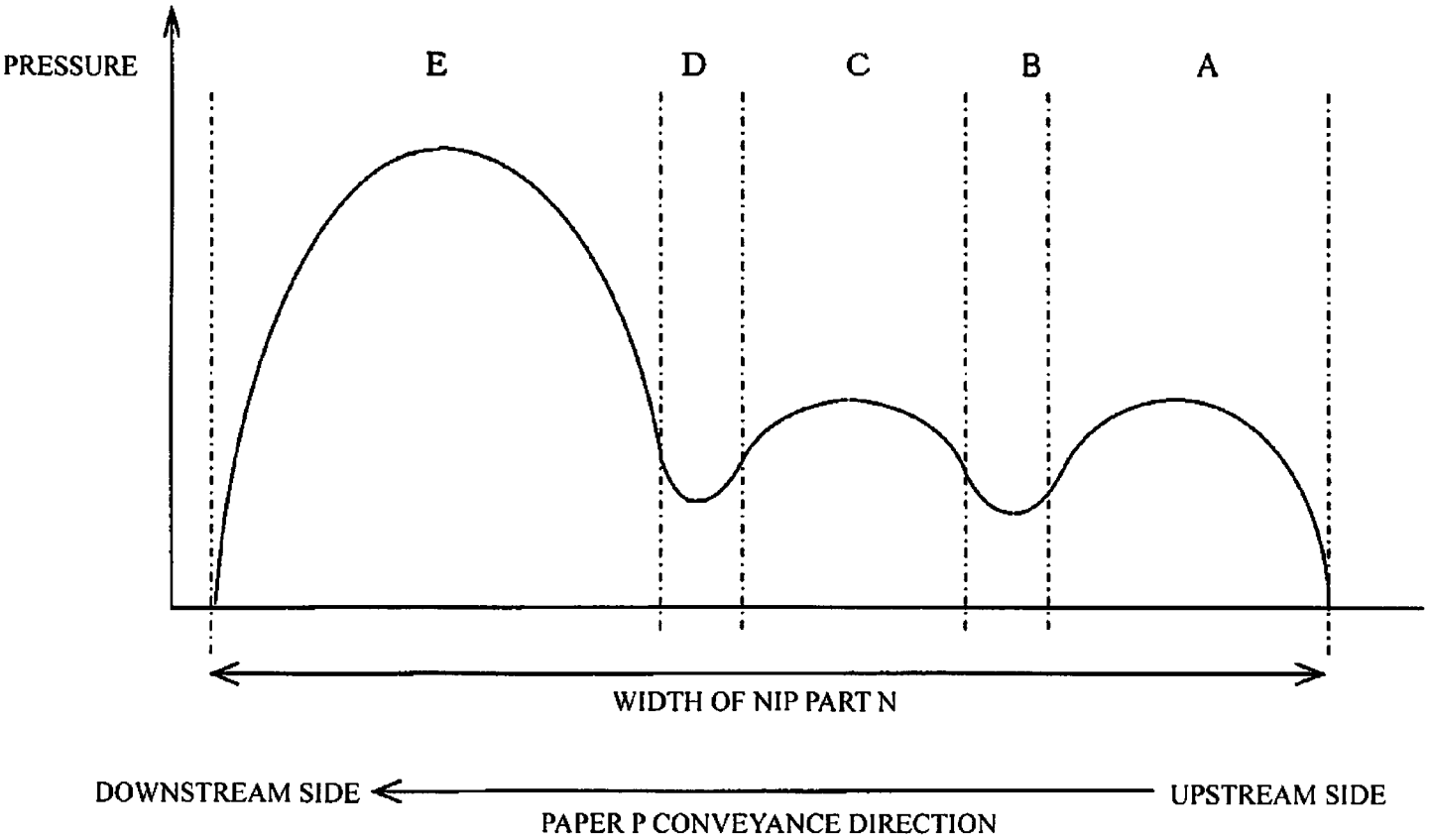
FIG. 22 is a graph illustrating pressure distribution in the fixation device having the configuration of the first embodiment.

Now, FIG. 22 illustrates the pressure distribution of fixation device 14 of the embodiment. The nip area W is the area where the part between first fixation roller 321 and second fixation roller 322 is in contact with pressurization roller 30. Nip area A represents the distribution of pressure generated by pressurization roller 30 pressing second fixation roller 322. Nip area C represents the distribution of pressure generated by pressurization roller 30 pressing pad 401. Nip area E represents the distribution of pressure generated by pressurization roller 30 pressing first fixation roller 321. With pressurization roller 30 pressing against fixation belt 33, nip areas (low pressurized areas) B and D are formed between nip areas A and C, and between nip areas C and E. In those nip areas B, D, fixation belt 33 is pressed against pressurization roller 30 due to the tension of the belt.

In addition, with the configuration of the press mechanism described above, a peak of the average pressure of nip area E in the longitudinal direction (hereinafter referred to as "nip area E pressure") is set to be 2.0 to 2.5 kgf/cm$^2$. A peak of the average pressure of nip area C in the longitudinal direction (hereinafter referred to as "nip area C pressure") is set to be 0.8 to 1.0 kgf/cm$^2$, and a peak of the average pressure of nip area A in the longitudinal direction (hereinafter referred to as "nip area A pressure") is set to be 0.8 kgf/cm$^2$. Specifically, nip area A pressure and nip area C pressure are set lower than nip area E pressure.

Figure 23:
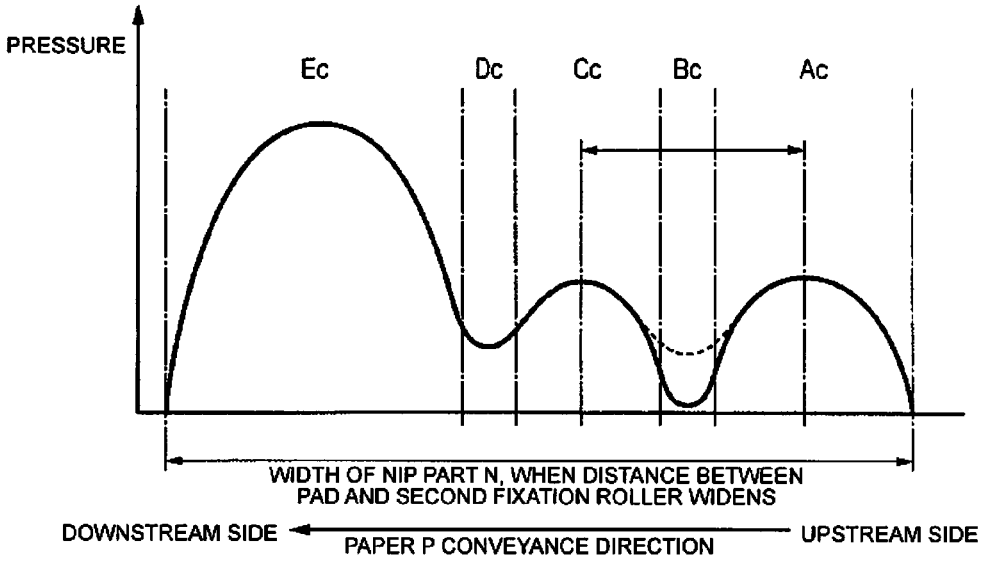
FIG. 23 is a graph illustrating pressure distribution of a fixation device of a conventional configuration.

In contrast to this, in the configuration like the comparative example, the width of nip part N widens, and the pressure is distributed as illustrated in FIG. 23. As illustrated in the drawing, a low pressurized area (almost no pressure) is generated in nip area Bc formed between the pad and the second fixation roller. This is presumably because pressure generated as a result of the pad tip entering a gap between the second fixation roller and the pressurization roller can no longer control the belt as the pad leaves the second fixation roller, thereby disabling the generation of pressure which would otherwise be generated in normal circumstances (pressure shown by the dashed line in nip area Bc in FIG. 23). Nip area Bc becomes susceptible to a toner image distortion because not only can the movement of air, steam and the like, generated from a toner layer when paper P passes through the nip, no longer be suppressed, but also minute skidding easily occurs between paper P surface and fixation belt 33. Use of paper with poor ventilation such as coated paper increases the distortion.

In the embodiment, by having pad 401 and second fixation roller 322 supported and arranged on the same pad lever 46, a variation in the distance between pad 401 and second fixation roller 322 can be made smaller. As a result, a pressure distribution as illustrated in FIG. 22 can be achieved. Because generation of the low pressurized area is controlled in the pressure distribution shown in FIG. 22, a good printing result free from the toner image distortion can be obtained.

As described above, in fixation device 14 of the embodiment, first fixation roller 321 is rotatably fixedly-supported on support frame 48, and both pad 401 and second fixation roller 322 are respectively held on pad lever 46, which is a lever member (holding plate). Specifically, pad 401 is held on and guided by pad lever 46, and second fixation roller 322 is held on the same pad lever 46. Thus, a drop in nip pressure can be reduced by a reduction of movable members and errors in dimensions.

Thus, with fixation device 14 of the embodiment, since any variation in the distance between second fixation roller 322 and pad 401, or backlash of the tip section of pad 401, can be controlled, a drop in pressure between two members can be prevented and any variation in pressure can be controlled.

With these, fixation device 14 is capable of effectively controlling the occurrence of the problem of image distortion. Accordingly, a printer of high image quality can be provided.

Second Embodiment

A second embodiment of the invention is described below. In the embodiment, second fixation roller 322 is fixed to support frame 48 so that the abutting pressure between first fixation roller 321, second fixation roller 322, and pressurization roller 30 is increased, as the print speed is accelerated. Specifically, first fixation roller 321 and second fixation roller 322 are fixed to support frame 48, and pad 401 is supported on holding plate 46.

First, a fixation device and a printer of the embodiment are described with reference to FIG. 24 and FIG. 25. Note that parts similar to the fixation device and the printer of the first embodiment are assigned identical reference numerals and a description thereof is omitted.

In contrast to the configuration of the first embodiment described above, fixation device 14 of the second embodiment is configured so that second fixation roller 322 is directly supported on support frame 48. With this, any variation in a distance between pad 401 and second fixation roller 322 can be controlled. Furthermore, the second fixation roller is configured to have a larger outside diameter. This makes nip part N longer and further increases a pressure peak to be described below, thus making the fixation device capable of further accelerating the print speed.

FIG. 24 to FIG. 27 illustrate modes of support pad 401, of pad lever 46 and of second fixation roller 322 of the embodiment. In addition, FIG. 28 illustrates the side geometry of pad lever 46.

Figure 24:
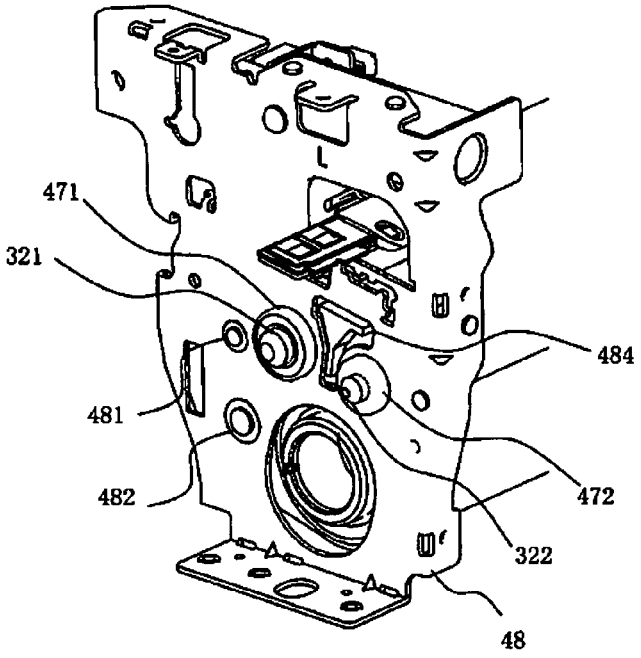
FIG. 24 is a perspective view illustrating a support frame to which a pressurization roller and other parts are mounted.

In this embodiment, as illustrated in FIG. 24, a configuration is such that second fixation roller 322 is supported on support frame 48 via bearing 472.

Figure 28:
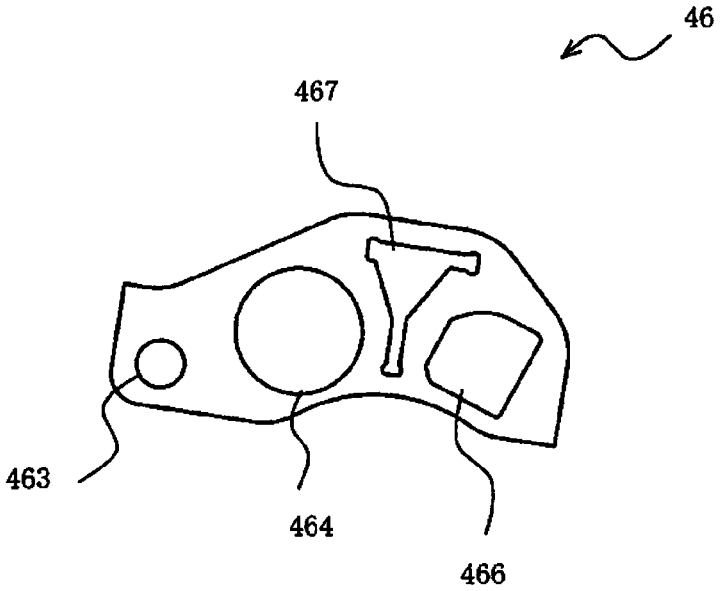
FIG. 28 is a side elevation view illustrating a pad lever according to a second embodiment.

As illustrated in FIG. 28, in the pad lever 46 set up, from the upstream side of the paper conveyance direction, includes a second fixation roller loose hole 466 for allowing relative movement of second fixation roller 322 when pad lever 46 swings to prevent interference of pad lever 46 and second fixation roller 322, a pad support hole 467 for fixedly-holding pad 401, a first fixation roller loose hole 464 for preventing interference by escaping from a metal core shaft part of first fixation roller 321, and pad lever pivot hole 463.

Figure 26:
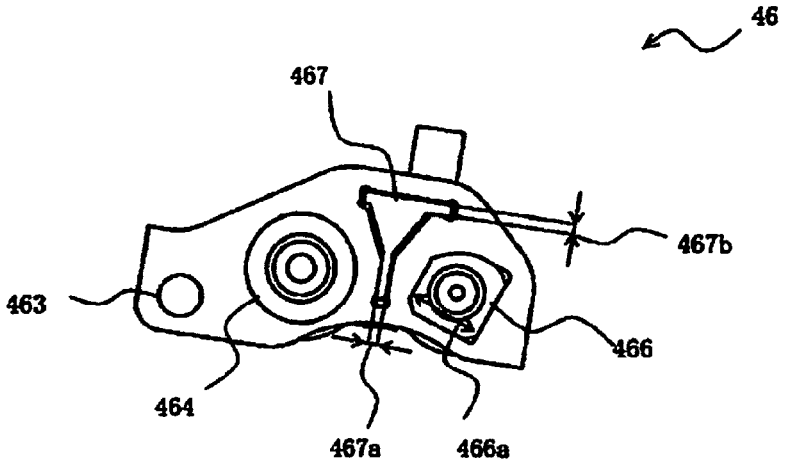
FIG. 26 is a side elevation view illustrating a pad lever to which a first fixation roller and other parts are mounted.
Figure 27:
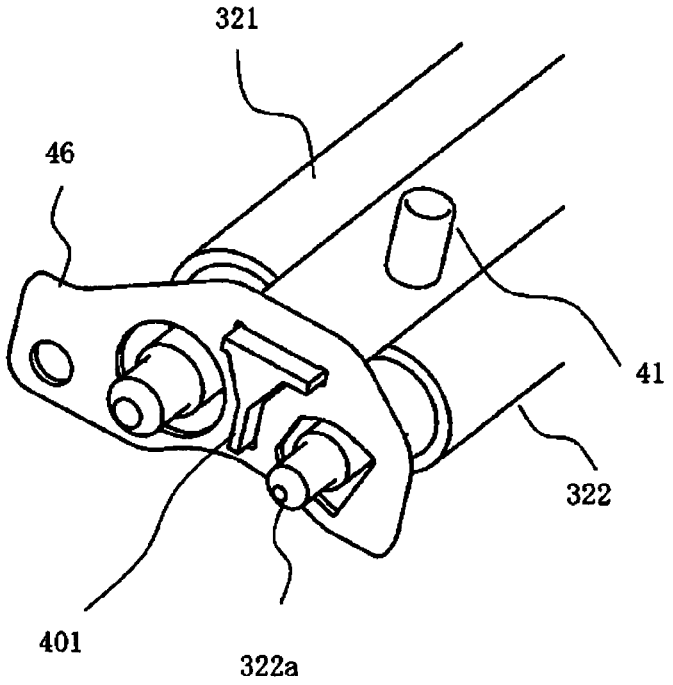
FIG. 27 is a perspective view illustrating a mounting structure of the first fixation roller, the second fixation roller and a pad.

FIG. 26 and FIG. 27 illustrate the mode of holding pad 401. As described above, the cross section of pad 401 is almost shaped like the letter T board. The board thickness of each part, being W1 and W2, is made or formed with dimensions so to have the smallest gap with hole width 467*a*, 467*b* of pad support hole 467.

Figure 25:
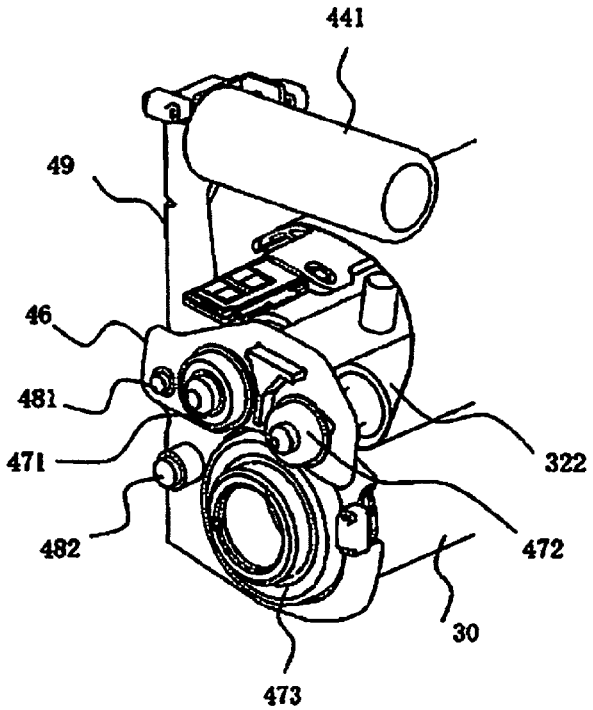
FIG. 25 is a perspective view illustrating a mounting structure of the pressurization roller and other parts.

FIG. 24 and FIG. 25 illustrate the mode of holding second fixation roller 322. Second fixation roller 322 is supported on support frame 48 via bearing 472, without interfering with pad lever 46. In pad lever 46, second fixation roller 322 is passed through loose hole 466 with width 466*a* provided in pad lever 46. Pad lever pivot hole 463 is attached to pivot shaft 481 provided in support frame 48 and pad lever 46 is swingably supported on support frame 48. Then, loose hole 466 of pad lever 46 is structured to allow pad 401 to swing in a swinging range of pad 401, thereby preventing interference between pad 401 and second fixation roller 322 and between pad lever 46 and second fixation roller 322.

In the embodiment, pressurization roller 30 abuts on fixation rollers 321 and 322 which are both rotatably supported on support frame 48. In this state, pressurization roller lever 49 is rotatably supported on pressurization lever pivot shaft 482 of support frame 48. Pressurization roller lever 49 and pressurization lever pivot shaft 482 are in a relationship as described below.

Being supported on pressurization lever pivot shaft 482, pressurization roller lever 49 presses pressurization roller 30 against first fixation roller 321 and second fixation roller 322. Pressurization roller 30 is pressed in a direction in which the center of a circumference of pressurization roller 30 in contact with fixation belt 33 passes through a midpoint between the rotation center of first fixation roller 321 and the rotation center of second fixation roller 322. In this design, pressurization lever pivot shaft 482 is provided at a higher position than pressurization lever pivot shaft 482 of the first embodiment. A pressing force of pressurization roller 30 supported on pressurization roller lever 49 acts equally when pressurization roller 30 initially comes into contact with first fixation roller 321 and second fixation roller 322, and gradually a stronger pressing force acts on first fixation roller 321. Pressurization roller 30 moves on an arc with pressurization lever pivot shaft 482 centered. Therefore, if pressurization roller 30 is strongly pressed against first fixation roller 321 and second fixation roller 322, a stronger pressing force acts on first fixation roller 321 than the pressing force applied to second fixation roller 322. The change in the pressing force varies depending on the positional relationship among pressurization lever pivot shaft 482, first fixation roller 321, and second fixation roller 322. Therefore, pressurization roller lever 49 can be designed such that predetermined pressing forces can be obtained between pressurization roller 30 and first fixation roller 321, between pressurization roller 30 and pad 401, and between pressurization roller 30 and second fixation roller 322 through the adjustment of a position to mount pressurization lever pivot shaft 482, or the setting of a compressive strength of pressurization roller spring 441.

First fixation roller 321 of the embodiment is a roller having an outside diameter of 24 mm. The roller has metal core 321*a* which is an iron (STKM)-made solid shaft having a diameter of 20 mm and a length of 230 mm, and a foamed silicone rubber (sponge) layer having a thickness of 2 mm and an expansion ratio of 2 which is formed as elastic layer 321*b*. The roller product hardness is set to ASKER-C70. First fixation roller 321 is shaped like a crown which has the outside diameter of a center part being 0.2 mm larger than the outside diameter of both ends, so that the pressure distribution of first fixation roller 321 and pressurization roller 30 in a longitudinal direction is uniform.

Second fixation roller 322 has an outside diameter of 14 mm. The roller has metal core 322*a* which is an iron (STKM)-made solid shaft having a diameter of 10 mm and a length of 230 mm, and a foamed silicone rubber (sponge) layer having a thickness of 2 mm and an expansion ratio of 2 which is formed as elastic layer 322*b*. The roller product hardness is set to ASKER-C75. Second fixation roller 322 is shaped like a crown which has an outside diameter of a center part being 0.1 mm larger than that of both ends, so that the pressure distribution with pressurization roller 30 in the longitudinal direction is uniform. Other configurations of the rollers and the pads are similar to those of the first embodiment.

Pressurization roller 30 is set so that a press mechanism, which is not shown, presses first fixation roller 321 and second pressurization roller 324 with a total pressing force of 50 kgf for both sides, or in other words, 25 kgf each for one side. Furthermore, pad 402 is set to press pressurization roller 30 with a total load of 5 kgf. Then, a load direction of pressurization roller 30 is the direction passing through a midpoint between the rotation center of first fixation roller 321 and the rotation center of second pressurization roller 324. This enables pressurization roller 30 to apply equal loads to both first fixation roller 321 and second pressurization roller 324.

With the above configuration, the nip width formed by pressurization roller 30 and first fixation roller 321 is 7 mm. The nip width formed by pressurization roller 30 and pad 401 is 6 mm. The nip width formed by pressurization roller 30 and second fixation roller 322 is 6 mm, and the width of nip part N of the embodiment is about 19 mm. Note that print speed is set to 50 ppm for A4 portrait paper feeding.

In addition, the output of heater 34 is set to a total of 1100 W. Note that although no heater is arranged inside pressurization belt unit 45 in this embodiment, a configuration may be such that the heater is arranged in pressurization belt unit 45, as with the fixation belt unit 31 side.

Figures 29, 30:
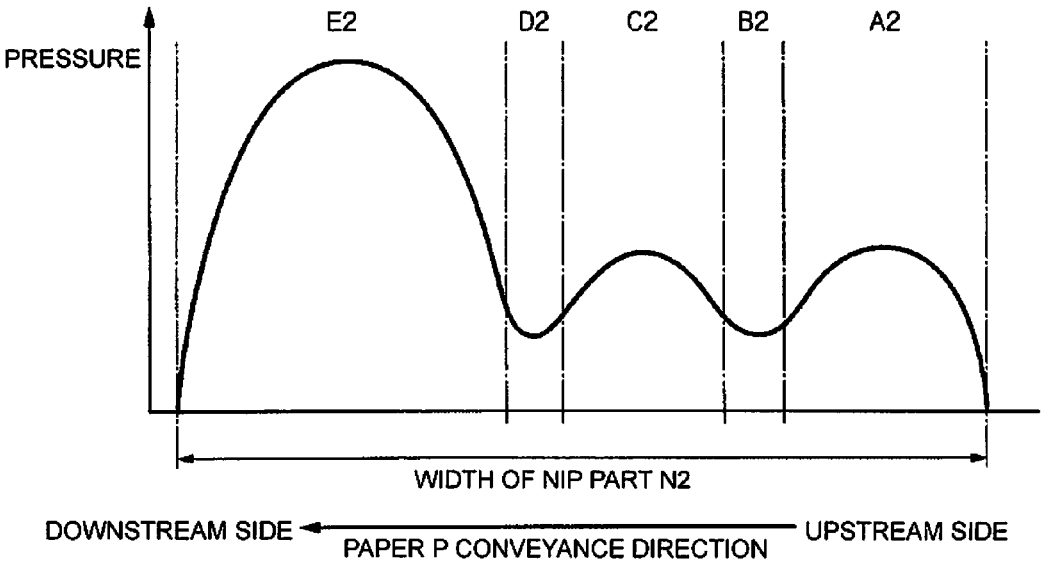
FIG. 29 is a graph illustrating pressure distribution in a fixation device having a configuration of the second embodiment.
FIG. 30 is a table illustrating an evaluation result of each configuration when printing is performed with evaluation conditions set in the second embodiment.

FIG. 29 illustrates a pressure distribution by the configuration of this embodiment. Nip area N is the area where fixation belt 33 winds around first fixation roller 321 and second fixation roller 322 is in contact with pressurization roller 30. Nip area A2 represents a distribution of the pressure generated by pressurization roller 30 pressing second fixation roller 322. Nip area C2 represents a distribution of the pressure generated by pad 401 and pressurization roller 30 pressing each other, and nip area E2 represents distribution of pressure generated by pressurization roller 30 pressing first fixation roller 321. By pressurization roller 30 pressing fixation belt 33, nip areas (low pressurized areas) B2, D2 are formed between nip areas A2 and C2, and between nip areas C2 and E2. In those nip areas B2, D2, fixation belt 33 is pressed against pressurization roller 30 due to the tension of the belt. In this embodiment, with the configuration of the press mechanism described above, a peak of an average pressure of nip area E2 in the longitudinal direction (hereinafter referred to as "nip area E2 pressure") is set to be 2.0 to 2.5 kgf/cm$^2$. A peak of the average pressure of nip area C2 in the longitudinal direction (hereinafter referred to as "nip area C2 pressure") is set to be 0.8 to 1.0 kgf/cm$^2$, and a peak of the average pressure of nip area A2 in the longitudinal direction (hereinafter referred to as "nip area A2 pressure") is set to be 1.0 to 1.5 kgf/cm$^2$. Specifically, nip area A2 pressure and nip area C2 pressure are set lower than nip area E2 pressure. In this embodiment, unlike in the first embodiment, second fixation roller 322 is axially- and fixedly-supported on support frame 48, which thus enables nip area A2 pressure and nip area B2 pressure to be set higher.

Thus, an increase in the pressing force at the apex of C2 is smaller than that at the apices of A2 and E2. In addition, the nip width is widened more than in the first embodiment. This is because the pressing force of the pressurization roller on the first fixation roller and the second fixation roller increases, thereby increasing an amount by which the elastic layer is crushed.

A printing operation of printer 1 and a fixing operation of fixation device 14 in this embodiment are similar to the first embodiment and thus a description thereof is omitted. In fixation device 14, which is a characteristic configuration of the embodiment, an evaluation test similar to the first embodiment is performed. Note that in the embodiment, the first embodiment is used as a comparative example. In the evaluation test of the embodiment, printing is performed with three levels of the print speed of 50 ppm, 45 ppm, and 40 ppm for A4 portrait feeding.

FIG. 30 illustrates an evaluation result of each configuration under the evaluation conditions described above. As illustrated in FIG. 30, it can be seen that until the print speed reaches 50 ppm, no image distortion occurs in the configuration of the embodiment in which first fixation roller 321 and second fixation roller 322 are supported by support frame 48 and pad 401 therebetween is supported by pad lever 46.

The first embodiment, which is the comparative example, has the structure (second fixation roller 322 is movable) that pressurization roller 30 and second fixation roller 332 are opposed and press each other by means of a spring force. Thus, even if the pressurization roller spring force is increased to increase the nip width, thereby increasing a pressing force to further accelerate the print speed, two springs are stabilized at an amount of contraction at which their loads counterbalance, since the amount of contraction of the spring is proportional to the loads according to Hooke's law. Consequently, the two springs both contract, and pressure therebetween does not increase for the increased pressing force. Specifically, even if pressure of the pressurization roller is increased, pressure of second fixation roller 322 and the pressurization roller cannot be increased because the second fixation roller is also of a type of spring pressing, and force is thus absorbed by a pressing of the spring. Thus, it is difficult to increase the pressure of nip area A2 and nip area B2. In this embodiment, with second fixation roller 322 being axially- and fixedly-supported on support frame 48, the pressing force of pressurization roller 30 on second fixation roller 322 can be increased. Specifically, since second fixation roller 322 is axially- and fixedly-supported on support frame 48, nip area A2 pressure and nip area B2 pressure can be increased by increasing the load of pressurization roller 30.

As a result, in the configuration of the first embodiment described above, although the quality is good until the print speed reaches 40 ppm, the image distortion occurs when the speed becomes faster. It is believed that this is because the pressure in the range from nip area A to B is relatively insufficient for the accelerated print speed. It is presumed that a toner image distortion easily occurs because the amount of air, steam and the like generated per unit time from a medium which moves at a higher speed in the range of nip area A to B when it passes through the nip increases, and movement thereof can no longer be suppressed. Consequently, minute skidding easily occurs between paper P surface and fixation belt 33.

In a mode of this embodiment, with second fixation roller 322 being axially- and fixedly-supported on support frame 48, nip area A2 pressure can be set high, and nip area A2 pressure is set high in this embodiment. Thus, nip area B2 pressure, which is a low pressurized area, can be enhanced, and even under the high-speed printing conditions, toner image distortion can be prevented from occurring.

As described above, with the fixation device of the embodiment, the tip section of pad 401 is prevented from shaking due to first fixation roller 321 and second fixation roller 322 being fixed on support frame 48, pad 401 being held on pad lever 46, which is a holding plate, and pad 401 being guided by pad lever 46. Moreover, with second fixation roller 322 being fixed, the distance between pad 401 and second fixation roller 322 is less susceptible to an error, and thus a drop in the nip pressure can be reduced.

Since first fixation roller 321 and second fixation roller 322 are fixed to support frame 48, only pad 401 moves and an error in dimensions occurs only in this pad 401. Then, with pad 401 being guided by pad lever 46, the distance between second fixation roller 322 and pad 401 is less susceptible to an error, the pressing force becomes stable, and the printing quality can thereby be maintained.

As a result of this, with the fixation device of this embodiment, the nip width and pressure of the second fixation roller can be further increased when compared with the first embodiment. Thus, even in a state in which the print speed is increased, an occurrence of the problem of fixed image quality (image distortion) can be controlled. In addition, with the fixation device of the embodiment equipped, an image formation apparatus capable of controlling the problem of fixed image quality (image distortion), even in a state in which the print speed is increased can be controlled or prevented.

Note that if first fixation roller 321, second fixation roller 322 and pad 401 were fixed together to support frame 48, the accuracy of the positions of these three parts would improve. However, when pad 401 is fixed, the pressure distribution in an axial direction of pressurization roller 30 between pad 401 and pressurization roller 30 may become non-uniform since pad 401 is harder than fixation rollers 321, 322, which may possibly result in deteriorated print quality. On the one hand, since fixation rollers 321, 322 are softer than pad 401, the elasticity of fixation rollers 321, 322, even if the fixation rollers 321, 322 are fixed to support frame 48, can absorb an error in the mounting positions and can thus absorb non-uniformity in the pressure distribution in the axial direction of pressurization roller 30 between pad 401 and pressurization roller 30.

INDUSTRIAL APPLICABILITY

The invention is not limited to the embodiments, but may be variously modified based on the intent of the invention, and descriptions of particular embodiments do not limit the scope of the invention. Thus, the effects of the invention are not limited to what has been described above. In addition, the members described throughout the specification are only exemplary, and not limited to the descriptions. Various additions, changes, combinations and partial deletions and the like may be made without departing from the conceptual idea and intent of the invention which are derived from what are stipulated in the claims and equivalents thereof.

In the embodiments, while the image formation apparatus is described as being a color printer, the image formation apparatus is not limited to the embodiments described above, and may be a monochrome printer, a copier, a fax machine, a multifunction printer and the like. The image formation apparatus may also be a printer other than an electrographic printer or the like.

In the embodiments, while a printing medium is described as being plain paper, the medium is not limited thereto, and may be an OHP sheet, a card, a postcard, a cardboard having weighing capacity of 250 g/m$^2$ or more, an envelope, a special paper such as a coated paper having a large heat capacity, and the like.

Furthermore, in the embodiments, while a heater is described as a sheet shaped heater, it may be a heater where its sliding contact surface with the fixation belt has almost the same level of curvature as the fixation belt, or a heater having a cylindrical shape, or a halogen heater. Furthermore, since the fixation belt is formed of a material capable of electromagnetic induction, induction heating may be applied, and the heater is not limited by a type or shape.

Furthermore, in the embodiments, while the heater is described as being arranged inside the fixation belt, it may also be arranged outside the fixation belt.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A fixation device comprising:

a heating member;

a fixation belt configured to be heated by the heating member and formed as an endless belt;

a first fixation member configured to abut on an inner circumferential surface of the fixation belt;

a second fixation member located upstream of the first fixation member in a paper conveyance direction and configured to abut on the inner circumferential surface of the fixation belt;

a press member located between the first fixation member and the second fixation member and configured to abut on the fixation belt;

a pressurization member configured to abut on an outer circumferential surface of the fixation belt, and press at least against the first fixation member and the press member via the fixation belt;

a support frame configured to support the first fixation member;

a holding plate configured to support the press member; and a press mechanism configured to support the pressurization member and to cause the pressurization member to press against the first fixation member and the press member, wherein the press mechanism includes a pressurization lever swingably supported on the support frame and configured to support the pressurization member, and a pressurization member bias unit configured to bias the pressurization lever to cause the pressurization member to press at least against the first fixation member and the press member.

2. The fixation device according to claim 1, wherein the holding plate is swingably supported on the support frame.

3. The fixation device according to claim 2, wherein the holding plate comprises a pivot shaft supported on the support frame such that the holding plate is swingable.

4. The fixation device according to claim 1, wherein the press member is pressed by a bias member against a portion of the fixation belt on which the press member abuts.

5. The fixation device according to claim 4, wherein the bias member is an elastic member.

6. The fixation device according to claim 5, wherein the elastic member is a spring.

7. The fixation device according to claim 1, wherein the first fixation member and the second fixation member are supported on the support frame.

8. The fixation device according to claim 1, wherein the holding plate is configured to hold the press member in such a manner that the press member is swingable in a direction orthogonal to a paper conveyance direction.

9. The fixation device according to claim 1, wherein nip part pressure of the first fixation member is larger than nip part pressure of the second fixation member.

10. The fixation device according to claim 1, wherein each of the first fixation member, the second fixation member and the pressurization member is formed of a rotating body.

11. The fixation device according to claim 1, wherein the heating member is a sheet-shaped heater.

12. An image formation apparatus comprising the fixation device according to claim 1.

13. A fixation device comprising:

a heating member;

a fixation belt configured to be heated by the heating member and formed as an endless belt;

a first fixation member configured to abut on an inner circumferential surface of the fixation belt;

a second fixation member located upstream of the first fixation member in a paper conveyance direction and configured to abut on the inner circumferential surface of the fixation belt;

a press member located between the first fixation member and the second fixation member and configured to abut on the fixation belt;

a pressurization member configured to abut on an outer circumferential surface of the fixation belt, and press at least against the first fixation member and the press member via the fixation belt;

a support frame configured to support the first fixation member; and a holding plate configured to support the press member, wherein the second fixation member is pressed by a second fixation member bias unit, and the holding plate includes a support hole configured to hold the second fixation member in such a manner that the second fixation member is swingable in a direction in which the second fixation member is pressed by the second fixation member bias unit.

14. The fixation device according to claim 13, wherein the support hole extends in a biasing direction of the second fixation member bias unit.

* * * * *